US008402904B2

(12) United States Patent
Fujihara

(10) Patent No.: US 8,402,904 B2
(45) Date of Patent: Mar. 26, 2013

(54) SEWING MACHINE AND COMPUTER-READABLE MEDIUM STORING SEWING MACHINE CONTROL PROGRAM

(75) Inventor: Shinya Fujihara, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 328 days.

(21) Appl. No.: 12/847,521

(22) Filed: Jul. 30, 2010

(65) Prior Publication Data

US 2011/0041742 A1 Feb. 24, 2011

(30) Foreign Application Priority Data

Aug. 21, 2009 (JP) ..... 2009-191576

(51) Int. Cl.
*D05B 19/00* (2006.01)
*D05B 73/02* (2006.01)

(52) U.S. Cl. ..... 112/470.01; 700/136

(58) Field of Classification Search ..... 112/470.01–470.18, 271, 217.2, 112/260, 220, 221; 700/136–138
See application file for complete search history.

(56) References Cited

U.S. PATENT DOCUMENTS

| | | | | | |
|---|---|---|---|---|---|
| 4,784,071 | A | * | 11/1988 | Sadeh et al. | 112/470.07 |
| 4,798,152 | A | * | 1/1989 | Simons et al. | 112/470.05 |
| 4,998,489 | A | | 3/1991 | Hisatake et al. | |
| 5,027,726 | A | * | 7/1991 | Brower et al. | 112/117 |
| 5,323,722 | A | | 6/1994 | Goto et al. | |
| 5,911,182 | A | * | 6/1999 | Uyama et al. | 112/102.5 |
| 6,263,815 | B1 | | 7/2001 | Furudate | |
| 7,325,502 | B2 | * | 2/2008 | Konig et al. | 112/475.02 |
| 2002/0157588 | A1 | | 10/2002 | Musco et al. | |
| 2007/0227420 | A1 | | 10/2007 | Suzuki et al. | |
| 2010/0236463 | A1 | | 9/2010 | Fujihara et al. | |

FOREIGN PATENT DOCUMENTS

| | | | |
|---|---|---|---|
| JP | A-02-057288 | | 2/1990 |
| JP | A-04-364884 | | 12/1992 |
| JP | A-5-68760 | | 3/1993 |
| JP | Y2-07-001114 | | 1/1995 |
| JP | A-8-24464 | | 1/1996 |
| JP | 8071287 | * | 3/1996 |
| JP | A-8-71287 | | 3/1996 |
| JP | Y2-2503528 | | 7/1996 |

(Continued)

OTHER PUBLICATIONS

Office Action issued in Japanese Patent Application No. 2009-191576 dated Jun. 14, 2011 (with translation).

(Continued)

*Primary Examiner* — Ismael Izaguirre
(74) *Attorney, Agent, or Firm* — Oliff & Berridge, PLC

(57) ABSTRACT

A sewing machine includes a housing portion, a bed, a needle plate, an image capture device, a moving device, a command acquisition device, and a moving control device. The housing portion houses at least one needle bar. The needle plate is provided on the bed and includes a needle hole. The image capture device is adapted to capture an image of the needle hole. The moving device moves the image capture device in relation to the housing portion. The command acquisition device acquires a command to move the image capture device in relation to the housing portion. The moving control device controls the moving device in accordance with the command that has been acquired by the command acquisition device to move the image capture device in relation to the housing portion.

7 Claims, 40 Drawing Sheets

FOREIGN PATENT DOCUMENTS

| | | |
|---|---|---|
| JP | A-09-250068 | 9/1997 |
| JP | A-11-172566 | 6/1999 |
| JP | A-2000-235212 | 8/2000 |
| JP | U-3100627 | 5/2004 |
| JP | A-2005-177777 | 7/2005 |
| JP | A-2006-012203 | 1/2006 |
| JP | A-2006-169696 | 6/2006 |
| JP | A-2007-289653 | 11/2007 |

OTHER PUBLICATIONS

U.S. Appl. No. 12/847,550, filed Jul. 30, 2010 in the name of Shinya Fujihara.
Mar. 15, 2011 Office Action issued in Japanese Application No. 2009-069185 (with translation).
Jul. 20, 2012 Office Action issued in U.S. Appl. No. 12/847,550.

* cited by examiner

SEWING MACHINE AND COMPUTER-READABLE MEDIUM STORING SEWING MACHINE CONTROL PROGRAM

CROSS-REFERENCE TO RELATED APPLICATION

This application claims priority to Japanese Patent Application No. 2009-191576, filed Aug. 21, 2009, the content of which is hereby incorporated herein by reference in its entirety.

BACKGROUND

The present disclosure relates to a sewing machine that is provided with an image capture device and to a computer-readable medium that stores a sewing machine control program.

A sewing machine is known that is provided with an image capture device such as a camera or the like. For example, a sewing machine is known that uses an image capture device to capture an image of an area around a needle drop point and displays the captured image on an image display device. A user can enlarge and reduce, as necessary, the size of the image that is captured by the image capture device. By looking at the image that is displayed on the image display device, the user can easily check the needle drop point and the state of the sewing without bringing the user's face close to the area around the needle drop point.

SUMMARY

In the known sewing machine, the image capture device is affixed to the sewing machine, so it is not possible to move the image capture device to a desired position. Therefore, the user cannot easily obtain the captured image under the condition in which the position of the image capture device and the direction is changed.

Various exemplary embodiments of the broad principles derived herein provide a sewing machine and a computer-readable medium that stores a sewing machine control program that are capable of moving the image capture device easily.

Exemplary embodiments provide a sewing machine that includes a housing portion, a bed, a needle plate, an image capture device, a moving device, a command acquisition device, and a moving control device. The housing portion houses at least one needle bar. The needle plate is provided on the bed and includes a needle hole. The image capture device is adapted to capture an image of the needle hole. The moving device moves the image capture device in relation to the housing portion. The command acquisition device acquires a command to move the image capture device in relation to the housing portion. The moving control device controls the moving device in accordance with the command that has been acquired by the command acquisition device to move the image capture device in relation to the housing portion.

Exemplary embodiments also provide a sewing machine that includes a housing portion, a bed, a needle plate an image capture device, a moving device, a command acquisition device, and a moving control device. The housing portion houses at least one needle bar. The needle plate is provided on the bed and includes a needle hole. The image capture device that is adapted to face downward and that is adapted to capture an image from above the needle hole. The moving device moves the image capture device in relation to the housing portion. The command acquisition device acquires a command to move the image capture device in relation to the housing portion. The moving control device controls the moving device in accordance with the command that has been acquired by the command acquisition device to move the image capture device in relation to the housing portion.

Exemplary embodiments further provide a computer-readable medium storing a control program executable on a sewing machine that includes a housing portion that houses at least one needle bar, with a bed, with a needle plate that is provided in the bed and includes a needle hole, and with an image capture device that is at least one of capable of capturing an image of the needle hole and capable of capturing an image facing downward from above the needle hole. The program includes instructions that cause a controller of the sewing machine to perform the steps of: acquiring a command to move the image capture device in relation to the housing portion, and controlling, in accordance with the command, a moving device that moves the image capture device in relation to the housing portion to move the image capture device in relation to the housing portion.

BRIEF DESCRIPTION OF THE DRAWINGS

Exemplary embodiments will be described below in detail with reference to the accompanying drawings in which.

DETAILED DESCRIPTION

Figure 1:
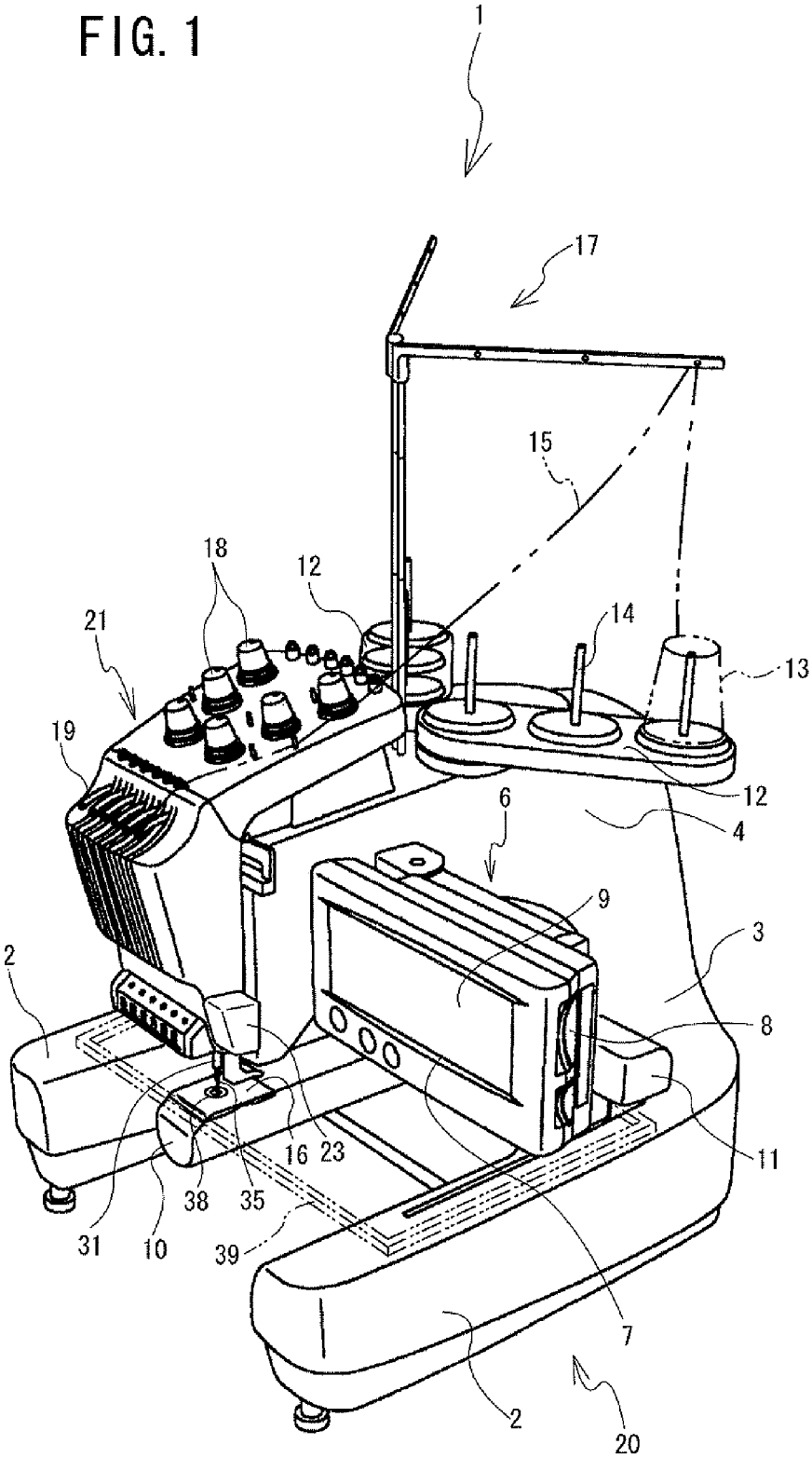
FIG. 1 is an oblique view of a multi-needle sewing machine.

Hereinafter, sewing machines according to first to fourth embodiments of the present disclosure will be explained with reference to the drawings. The referenced drawings are used for explaining technical features that may be utilized in the present disclosure, and the device configurations and the like that are described are simply explanatory examples that do not limit the present disclosure to only those configurations and the like. In FIGS. 7, 11, 13, 16, 20, 23, 27, and 29, members such as needle bars 31 and the like that are disposed on an inner side of a frame 24 are omitted from the drawings. A connector portion 153 has been omitted from the drawings, with the exceptions of FIGS. 6, 17, 24, and 35.

A physical configuration of a multi-needle sewing machine 1 (hereinafter simply called the sewing machine 1) of a first embodiment will be explained with reference to FIGS. 1 to 3. In the explanation that follows, in FIG. 1, the lower left side, the upper right side, the upper left side, and the lower right side of the page respectively indicate the front side, the rear side, the left side, and the right side of the sewing machine 1.

Figure 2:
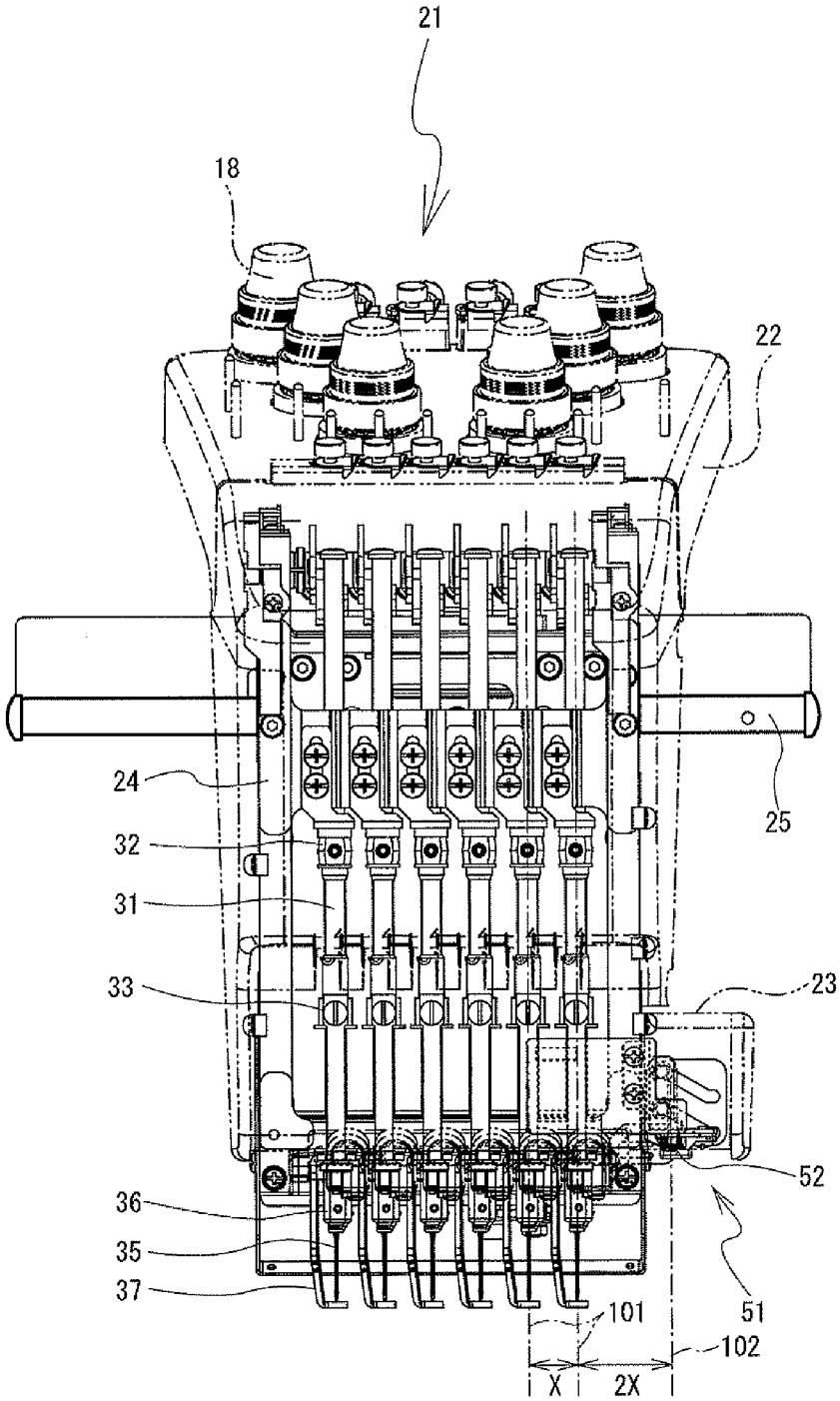
FIG. 2 is a transparent front view of a needle bar case.

As shown in FIGS. 1 and 2, the sewing machine 1 is a multi-needle sewing machine provided with six needle bars 31. A body 20 of the sewing machine 1 is provided with a supporting portion 2, a pillar 3, and an arm 4. The supporting portion 2 is formed in an inverted U shape in a plan view, and the supporting portion 2 supports the entire sewing machine 1. The pillar 3 is provided such that it rises upward from the rear portion of the supporting portion 2. The arm 4 extends forward from the upper end of the pillar 3. A needle bar case 21 is mounted on the front end of the arm 4 such that the needle bar case 21 can move to the left and to the right in relation to the body 20. The needle bar case 21 will be described in detail later.

An operation portion 6 is provided on the right side of the arm 4 at a central position in the front-to-rear direction. A vertically extending shaft (not shown in the drawings) serves as an axis of rotation on which the operation portion 6 is pivotally supported by the arm 4. The operation portion 6 includes a liquid crystal display (hereinafter simply called the LCD) 7, a touch panel 9, and a connector 8. An operation screen for a user to input commands, for example, may be displayed on the LCD 7. The touch panel 9 may be used to accept commands from the user. The user can select various types of conditions relating to a sewing pattern and sewing by using a finger, a stylus pen or the like to perform a pressing operation (the operation hereinafter being called a panel operation) on a location on the touch panel 9 that corresponds to a position on a screen that is displayed on the LCD 7 and that shows an input key or the like. The connector 8 can be connected to a memory card 160 (refer to FIG. 8).

A cylindrical cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the front end of the top face of the cylinder bed 10. A needle hole 38 through which a needle 35 passes is provided in the needle plate 16. The needle drop point is the point where the needle 35 pierces the work cloth 39.

A Y carriage 11 of an embroidery frame moving mechanism (not shown in the drawings) that moves embroidery frame 39 to the left and the right, and forward and backward is provided underneath the arm 4. When an embroidery pattern is sewn, the embroidery frame 39 which holds the work cloth (not shown in the drawings) is set in an X carriage (not shown in the drawings) of the embroidery frame moving mechanism. The sewing machine 1 performs sewing of an embroidery pattern on a work cloth (not shown in the drawings) that is held by the embroidery frame 39 as the embroidery frame 39 is moved to the left and the right, and forward and backward, by an X axis motor 132 (refer to FIG. 8) and a Y axis motor 134 (refer to FIG. 8) of the embroidery frame moving mechanism.

A right-left pair of spool platforms 12 are provided at the rear face side of the top face of the arm 4. Three thread spool pins 14 are provided on each of the spool platforms 12. The thread spool pins 14 support thread spools 13. The number of the thread spools 13 that can be placed on the one pair of the spool platforms 12 is six, the same as the number of needle bars 31. Upper threads 15 are supplied from the thread spools 13 that are disposed on the spool platforms 12. Each of the upper threads 15 is supplied, through a thread guide 17, a tensioner 18, and a thread take-up lever 19, to an eye (not shown in the drawings) of each of the needles 35 that are attached to the bottom ends of the needle bars 31.

A drive shaft (not shown in the drawings) extends in the front-to-rear direction in the interior of the arm 4. The drive shaft is rotated by a sewing machine motor 122 (refer to FIG. 8). A needle bar drive mechanism (not shown in the drawings) for moving one of the six needle bars 31 up and down is provided on the front end of the drive shaft. The needle bar drive mechanism converts the rotational movement of the drive shaft into a cranking movement of a crank lever (not shown in the drawings) that moves a movable body (not shown in the drawings) reciprocally up and down. The movable body engages an engaging pin (not shown in the drawings) for one of the needle bars 31 that is centrally located in the right-to-left direction of the sewing machine 1, so that the movable body may move the one of the needle bars 31 up and down. The shuttle drive mechanism (not shown in the drawings) is driven in conjunction with the rotation of the drive shaft. When the drive shaft rotates, the one of the needle bars 31, the corresponding thread take-up lever 19, and the shuttle (not shown in the drawings) are driven in a synchronized manner, and a stitch may be formed on the work cloth (not shown in the drawings).

The needle bar case 21 will be explained with reference to FIGS. 2 and 3. In the explanation that follows, in FIG. 2, the front side, the rear side, the left side, and the right side of the page respectively indicate the front side, the rear side, the left side, and the right side of the sewing machine 1. In FIG. 3, the left side, the right side, the rear side, and front side of the page respectively indicate the front side, the rear side, the left side, and the right side of the sewing machine 1.

Figure 3:
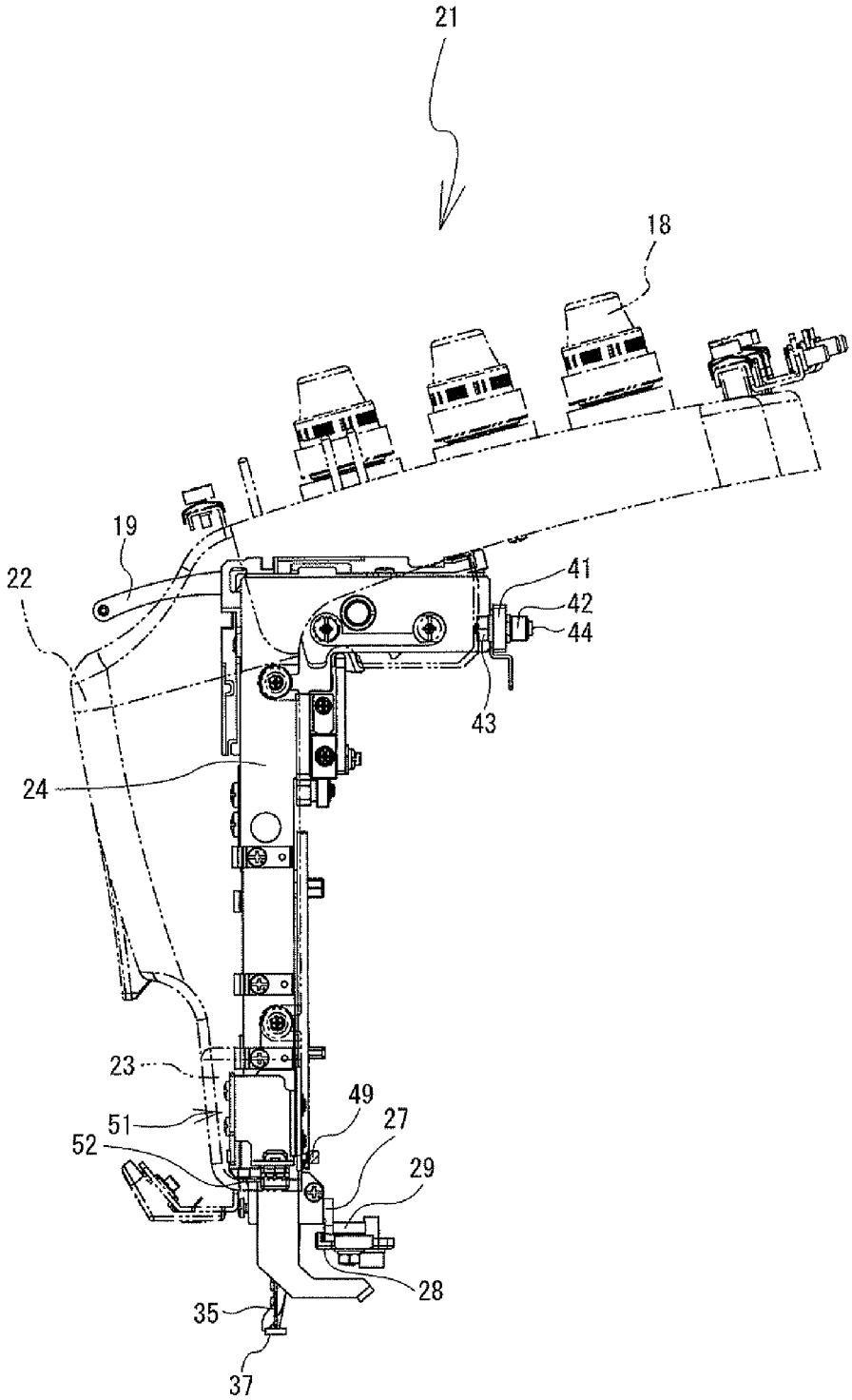
FIG. 3 is a transparent right side view of the needle bar case.

As shown in FIGS. 2 and 3, the frame 24 is provided in the interior of a cover 22 of the needle bar case 21. The frame 24 is rectangular when viewed from the front and has an inverted L shape when viewed from the right side. As shown in FIG. 2, a slide rail 25 that extends in the right-to-left direction is fixed to the front end portion of the arm 4 (refer to FIG. 1). The frame 24 is provided with a guide block (not shown in the drawings) slightly above the center point of the up-down direction. The guide block slides along the slide rail 25. As shown in FIG. 3, a restricting member 27 is fixed to the lower part of the rear face of the frame 24. The restricting member 27 restricts the movement of the frame 24 in the front-to-rear direction. A claw 28 and a plurality of rollers 29 are provided at the lower part of the front edge of the arm 4. The claw 28 engages the restricting member 27 on the frame 24. The plurality of the rollers 29 are in contact with the rear face of the restricting member 27. This configuration allows the frame 24 to smoothly move to the right and to the left in relation to the body 20 (refer to FIG. 1) while being guided by the slide rail 25.

Figure 4:
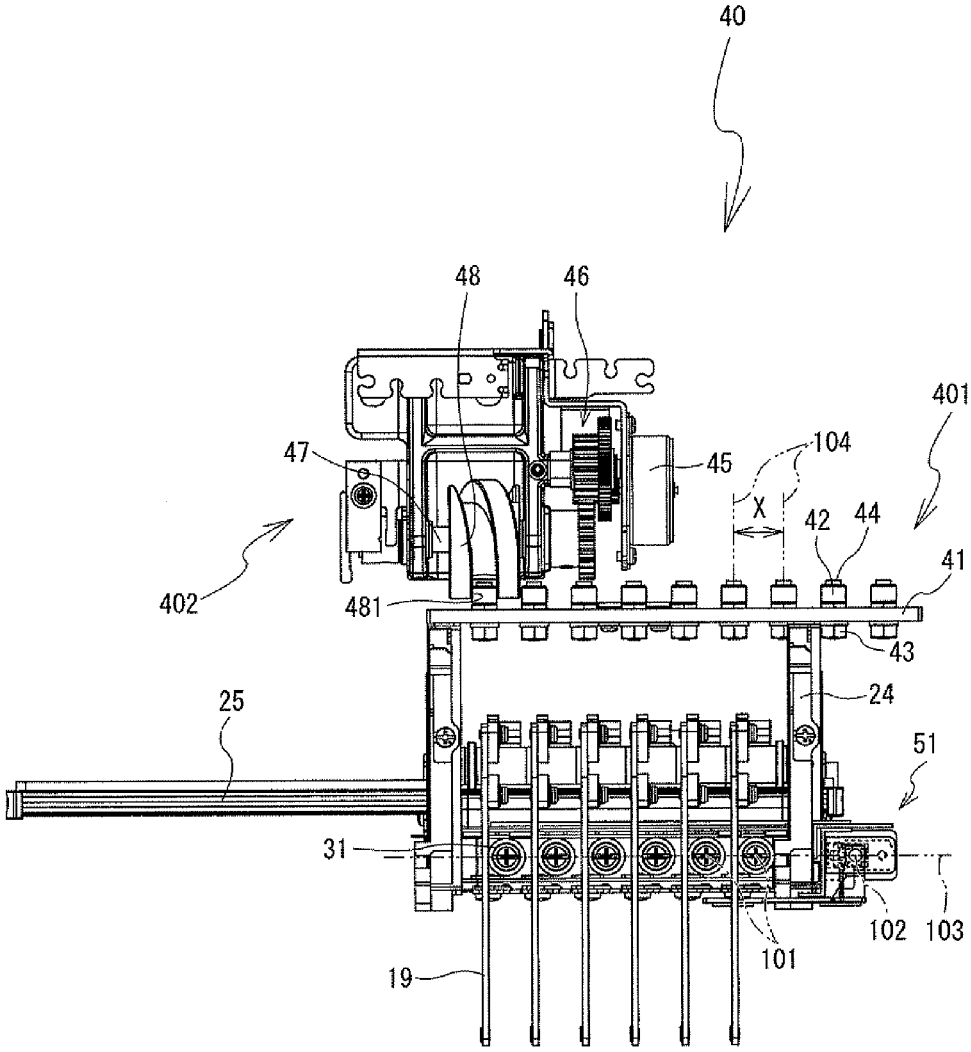
FIG. 4 is a plan view of a needle bar case moving mechanism in a case where a leftmost engaging roller is engaged with a positioning portion of a helical cam.

As shown in FIG. 2, the six needle bars 31 are lined up in the right-to-left direction inside the frame 24. A number from one to six is assigned to each of the six needle bars 31, starting from the right. Central axis lines 101 of the six needle bars 31 are each oriented in the vertical direction and are located in a single plane. In other words, in a plan view, as shown in FIG. 4, the central axis lines 101 of the six needle bars 31 are located on a single straight line 103. The intervals X between the central axis lines 101 of the needle bars 31 are all equal. Coil springs (not shown in the drawings) are mounted on the outsides of the needle bars 31, and the needle bars 31 are urged upward by the coil springs. The needle bars 31 are provided with needle bar holders 32 in the center of the up-down direction and are provided with presser holders 33 slightly below the center of the up-down direction. Needle holders 36 may each be fixed to the lower parts of the needle bars 31. The needles 35 may each be fixed to the needle holders 36. At this time, central axis lines of the needles 35 fixed to the needle holders 36 are aligned with the central axis lines 101 of the needle bars 31. Accordingly, the intervals between the central axis lines of the needles 35 are equal to the intervals X between the central axis lines of the needle bars 31. Presser feet 37 are extend from the presser holders 33 to slightly below the lower ends (the tips) of the needles 35. One of the presser feet 37 may move in conjunction with the up and down movement of one of the needles 35 and intermittently press the work cloth downward.

As shown in FIGS. 1 to 3, an image sensor holding mechanism 51 (hereinafter simply called the holding mechanism 51) is provided at the lower part of the right side face of the frame 24. The front face, the top face, and the right side face of the holding mechanism 51 are covered by a cover 23. The holding mechanism 51 holds an image sensor 52 above the cylinder bed 10, that is, higher than the needle hole 38, such that the position of the image sensor 52 in relation to the frame 24 can be changed. The holding mechanism 51 will be described in detail later.

At a position shown in FIG. 2, the distance between the central axis line 101 of the number one needle bar 31 and an optical axis 102 of the image sensor 52 is 2X, which is an integral multiple of the interval X between the needle bars 31. The number one needle bar 31 is the needle bar 31 that is the farthest to the right of the six needle bars 31. As shown in FIG. 4, in a plan view, the optical axis 102 of the image sensor 52 is located on the straight line 103 that passes through the central axis lines 101 of the six needle bars 31. The six needle bars 31 and the image sensor 52 are moved to the right and to the left in relation to the body 20 by moving the needle bar case 21 to the right and to the left.

A needle bar case moving mechanism 40 that moves the needle bar case 21 will be explained with reference to FIGS. 3 and 4. In FIG. 4, the lower side, the upper side, the left side, and the right side of the page respectively indicate the front side, the rear side, the left side, and the right side of the sewing machine 1.

As shown in FIG. 4, the needle bar case moving mechanism 40 is provided with an engaging roller portion 401 and a needle bar case drive portion 402. The engaging roller portion 401 is mounted on the frame 24. The engaging roller portion 401 includes a plate 41, engaging rollers 42, nuts 43, and shoulder screws 44. The plate 41 has a plate shape that is long in the left-right direction, and the plate 41 is attached to the rear edge of the upper portion of the frame 24, as shown in FIG. 3. As shown in FIG. 4, each of nine of the engaging rollers 42 is attached by one of the shoulder screws 44 to the rear face of the plate 41. Each of the engaging rollers 42 has a cylindrical shape, although this is not shown in detail in the drawings, and is supported by one of the shoulder screws 44 such that each of the engaging rollers 42 can rotate, but cannot move in the axial direction of the engaging roller 42. The shoulder screws 44 are inserted into holes in the plate 41 (not shown in the drawings) and are secured by the nuts 43. The intervals between the engaging rollers 42 (the intervals between central axis lines 104 of the engaging rollers 42) are all the same as the intervals X between the needle bars 31. The heights at which the nine engaging rollers 42 are attached are all the same.

The needle bar case drive portion 402 is located in the interior of the arm 4 (refer to FIG. 1), in a position that is to the rear of the plate 41. The needle bar case drive portion 402 includes a needle bar case motor 45, a gear portion 46, a rotating shaft 47, and a helical cam 48. The needle bar case motor 45 is a pulse motor. The needle bar case motor 45 is affixed such that the axial direction of an output shaft (not shown in the drawings) of the needle bar case motor 45 is oriented in the right-to-left direction. The needle bar case motor 45 transmits a driving force to the rotating shaft 47 via a gear portion 46, thus rotating the helical cam 48 by a specified amount. The rotating shaft 47 is supported in parallel with the output shaft of the needle bar case motor 45. The helical cam 48 is secured to the outer circumference of the rotating shaft 47 and is at all times engaged with one of the nine engaging rollers 42. The helical cam 48 includes a positioning portion 481. In a case where the rotation of the rotating shaft 47 has been stopped, one of the nine engaging rollers 42 is engaged with the positioning portion 481 of the helical cam 48. The positioning portion 481 is shaped such that the position of the engaging roller 42 that is engaged with the helical cam 48 does not change, even in a case where the rotating shaft 47 has been rotated to a specified angle. The positional relationship between the helical cam 48 and the engaging roller 42 that engages the helical cam 48 remains the same, no matter which of the engaging rollers 42 engages the positioning portion 481 of the helical cam 48.

In a case where the engaging roller 42 that is disposed the farthest to the left is engaged with the positioning portion 481 of the helical cam 48, as shown in FIG. 4, the needle bar 31 with the needle bar number six is disposed directly above the needle hole 38 (refer to FIG. 1). In a case where the engaging roller 42 that is the second from the left is engaged with the positioning portion 481 of the helical cam 48, the needle bar 31 with the needle bar number five is disposed directly above the needle hole 38. The same sort of relationships exist between the rest of the engaging rollers 42 and the needle bars 31. As will be described in detail later, in a case where one of the first and the second of the engaging rollers 42 from the right is engaged with the positioning portion 481 of the helical cam 48, the image sensor 52 is disposed directly above the needle hole 38. In the explanation that follows, a case where one of the engaging rollers 42 that is disposed from the first to the sixth from the left is engaged with the positioning portion 481 of the helical cam 48 is called a case in which the needle bar case 21 is in a sewing position. A case where one of the first and the second of the engaging rollers 42 from the right is engaged with the positioning portion 481 of the helical cam 48 is called a case in which the needle bar case 21 is in an image capture position.

The operation of moving the needle bar case 21 will be explained with reference to FIG. 4. The needle bar case 21 is moved by the needle bar case moving mechanism 40 in the left-right direction (the horizontal direction) in relation to the body 20. Every time the helical cam 48 rotates 360 degrees, the needle bar case moving mechanism 40 can move the needle bar case 21 by the distance X along the left-light direction. The direction in which the needle bar case 21 moves is determined according to the direction of the rotation of the helical cam 48. In a case where the helical cam 48 rotates counterclockwise as seen from the right side, the needle bar case 21 moves to the left. In a case where the helical cam 48 rotates clockwise as seen from the right side, the needle bar case 21 moves to the right.

Specifically, when the helical cam 48, starting from the state that is shown in FIG. 4, rotates counterclockwise as seen from the right side, the engaging roller 42 that is the farthest to the left slides leftward in relation to the helical cam 48, and the frame 24 starts moving to the left in relation to the body 20 (refer to FIG. 1). Next, the engagement between the helical cam 48 and the engaging roller 42 that is the farthest to the left is released, and the engaging roller 42 that is the second from the left engages the helical cam 48. In the state that is shown in FIG. 4, when the helical cam 48 makes one rotation counterclockwise as seen from the right side, the needle bar 31 that is the second from the left (the needle bar 31 with the needle bar number five) is accurately disposed directly above the needle hole 38. In other words, the frame 24 moves to the left from the position that is shown in FIG. 4 by the distance X. In contrast, when the helical cam 48 makes one rotation clockwise as seen from the right side, the frame 24 moves to the right in relation to the body 20 by the distance X. In this manner, every time the helical cam 48 makes one rotation, the needle bar case moving mechanism 40 can move the needle bar case 21 to one of the left and the right by the distance X, according to the direction of the rotation of the helical cam 48. The possible range of movement of the needle bar case 21 is defined by the slide rail 25 and the engaging rollers 42.

Figure 6:
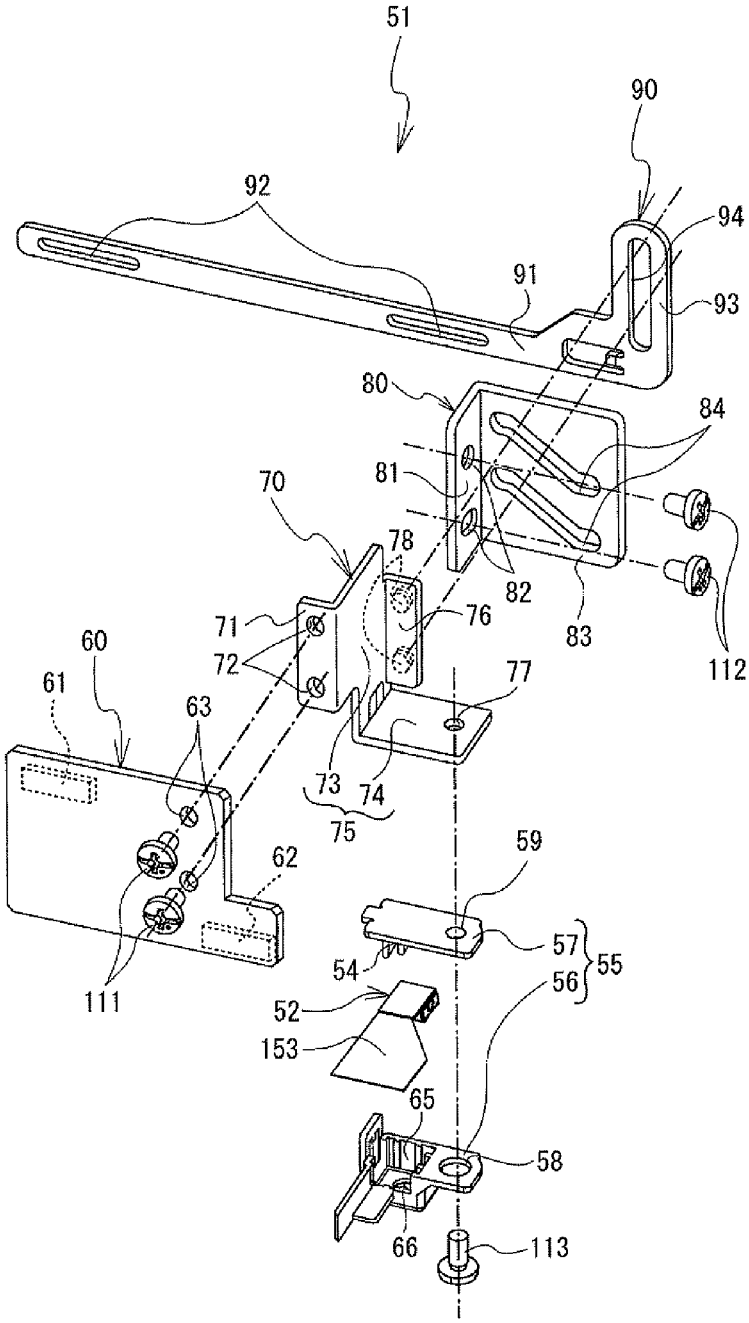
FIG. 6 is an oblique exploded view of the image sensor holding mechanism.
Figure 7:
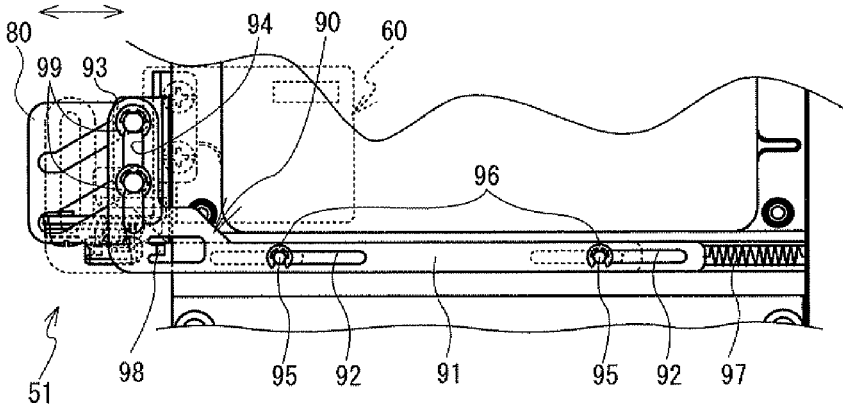
FIG. 7 is a rear side view of the image sensor holding mechanism.

The holding mechanism 51 will be explained with reference to FIGS. 2 to 7. In the explanation that follows, in FIG. 6, the lower left side, the upper right side, the upper left side, and the lower right side of the page respectively indicate the front side, the rear side, the left side, and the right side of the sewing machine 1. In FIG. 7, the left side, the right side, the front side and the rear side of the page respectively indicate the right side, the left side, the rear side, and the front side of the sewing machine 1.

Figure 5:
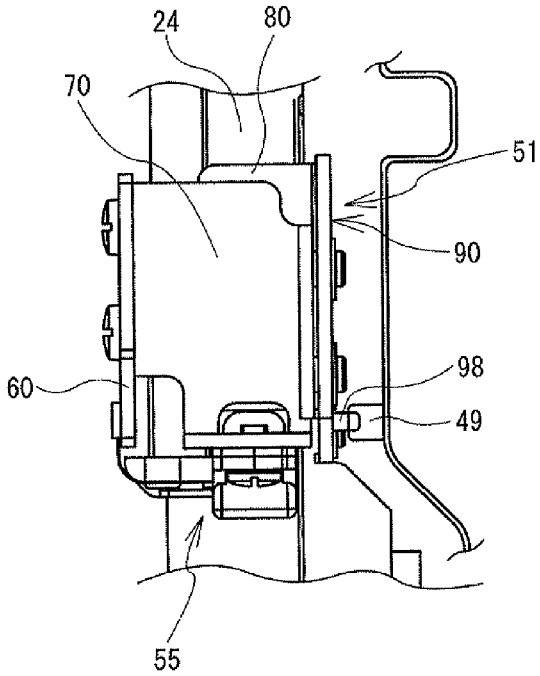
FIG. 5 is a right side view of an image sensor holding mechanism.

As shown in FIGS. 2 to 5, the holding mechanism 51 is attached to the lower portion of the right side face of the frame 24. The holding mechanism 51 supports the image sensor 52 such that the image sensor 52 can move in the left-right direction (the horizontal direction) in relation to the needle bar case 21. As shown in FIGS. 5 and 6, the holding mechanism 51 includes the image sensor 52, a sensor holder 55, a connecting plate 60, a sensor base plate 70, a cam plate 80, and a guide plate 90. The various members with which the holding mechanism 51 is provided will be described in detail below.

The image sensor 52 is a known complementary metal oxide semiconductor (CMOS) image sensor. The image sensor 52 is provided with the film-like connector portion 153. The connector portion 153 is connected to a connector 62 of the connecting plate 60, which will be described later. In a case where the needle bar case 21 has been moved to the image capture position, the image sensor 52 is disposed directly above the needle hole 38. As shown in FIG. 6, the sensor holder 55 includes a sensor support portion 56 and a sensor cover 57 that is made of plastic. A box-shaped recessed portion 65 is provided in the left portion of the sensor support portion 56. A circular opening 66 is provided in the bottom face of the recessed portion 65. A hole 58, into which a screw 113 is inserted, is provided in the right portion of the sensor support portion 56. The sensor cover 57 is a plate-shaped member that is rectangular in a plan view, and the sensor cover 57 is provided with a projecting portion 54 on its bottom face. A screw hole 59, into which the screw 113 is inserted, is provided in the right portion of the sensor cover 57. The image sensor 52 is inserted into the recessed portion 65 of the sensor support portion 56 such that a lens (not shown in the drawings) faces the opening 66 side (downward) and the image sensor 52 is held between the sensor support portion 56 and the sensor cover 57. The projecting portion 54 that is provided on the bottom face of the sensor cover 57 functions as a plastic spring that lightly presses upon the image sensor 52 from above, thus holding the image sensor 52 in place.

The connecting plate 60 is a plate that has an L shape when viewed from the front, and the connecting plate 60 electrically connects the image sensor 52 and a control portion 140 (refer to FIG. 8) of the sewing machine 1. The connecting plate 60 is provided with the connector 62 that is electrically connected to the connector portion 153 of the image sensor 52 and with a connector 61 that is electrically connected to the control portion 140 of the sewing machine 1. Two screw holes 63 are provided in the right portion of the connecting plate 60, one above the other.

The sensor base plate 70 supports the connecting plate 60 and the sensor holder 55, respectively. The sensor base plate 70 is supported by the guide plate 90 such that the sensor base plate 70 can move in the left-right direction in relation to the needle bar case 21. The sensor base plate 70 includes a plate connecting portion 71, a sensor connecting portion 75, and a guide plate connecting portion 76. The plate connecting portion 71 has a rectangular shape in a front view. Two screw holes 72 are provided in the plate connecting portion 71, one above the other. The connecting plate 60 is secured to the plate connecting portion 71 by screws 111 that are inserted into the screw holes 63 in the connecting plate 60 and the screw holes 72 in the plate connecting portion 71. In a front view, the sensor connecting portion 75 has an L shape that may be formed by bending a rectangular plate of a specified thickness at a right angle. The sensor connecting portion 75 includes a face 73 and a face 74. The face 73 extends at a right angle to the rear from the right edge portion of the plate connecting portion 71. The face 74 extends at a right angle to the right from the bottom edge of the face 73. The length of the sensor connecting portion 75 in the up-down direction is greater than the length of the plate connecting portion 71 in the up-down direction, and the upper edges of the sensor connecting portion 75 and the plate connecting portion 71 are both at the same height. A screw hole 77 is provided in the right portion of the face 74. The sensor holder 55 is secured to the bottom face of the sensor base plate 70 by the screw 113 that is inserted into the hole 58 and the screw hole 59 of the sensor holder 55 and into the screw hole 77 of the sensor connecting portion 75. The cover 23 is secured to the face 73 by an attaching portion (not shown in the drawings). The guide plate connecting portion 76 extends at a right angle to the right from a vertically central portion of the rear edge of the face 73. Two pins 78 are provided on the rear face of the guide plate connecting portion 76, one above the other. The pins 78 are cylindrical, and they are inserted into guide holes 84 of the cam plate 80, which is described below, and into a guide hole 94 of the guide plate 90, the rear ends of the pins 78 being secured by retaining rings 99 (refer to FIG. 7).

The cam plate 80 may be formed by bending a rectangular plate at a right angle, and the cam plate 80 includes a face 81 that extends in the front-to-rear direction and a face 83 that extends at a right angle to the right from the rear edge of the face 81. Two holes 82 are provided in the face 81, one above the other. The cam plate 80 is secured to the right side face of the frame 24 by screws 112 that are inserted into the holes 82. The two guide holes 84 are provided in the face 83 and are slanted in relation to the direction of movement of the needle bar case 21 (the horizontal direction). The two guide holes 84 are provided such that they are parallel in the up-down direction. The pins 78 of the sensor base plate 70 are inserted into the guide holes 84.

The guide plate 90 is L-shaped in a front view, and the guide plate 90 includes a plate-shaped slide portion 91 that is long in the left-right direction and a plate-shaped support portion 93 that is long in the up-down direction. Two guide holes 92 are provided in the slide portion 91 in the left-right direction. The guide holes 92 are elongated holes that are long in the left-right direction. The lengths of the guide holes 92 in the left-right direction are determined according to the range within which the guide plate 90 slides in relation to the frame 24. As shown in FIG. 7, positioning pins 95 that are press fitted into the frame 24 are inserted into the guide holes 92. The rear ends of the positioning pins 95 that are inserted into the guide holes 92 are secured by retaining rings 96. The guide plate 90 is supported on the frame 24 by the positioning pins 95 such that the guide plate 90 can slide in the left-right direction (the horizontal direction) in relation to the frame 24. One end of a spring 97 is attached to the left end of the slide portion 91. The other end of the spring 97 is secured to the frame 24, and the guide plate 90 is urged by the spring 97 toward the left side of the sewing machine 1. The guide hole 94 is located in the support portion 93, with its long dimension running in the up-down direction. The pins 78 of the sensor base plate 70 are inserted into the guide hole 94, and the ends of the pins 78 are secured by the retaining rings 99. A projecting portion 98 that projects toward the arm 4 is provided in the lower portion of the rear face of the support portion 93. In a case where the needle bar case 21 has been moved to a position (a third position) where the second engaging roller 42 from the right is engaged with the positioning portion 481 of the helical cam 48, the projecting portion 98 is in contact with a projecting portion 49 (refer to FIG. 5) that is provided in the interior of the arm 4.

Figure 8:
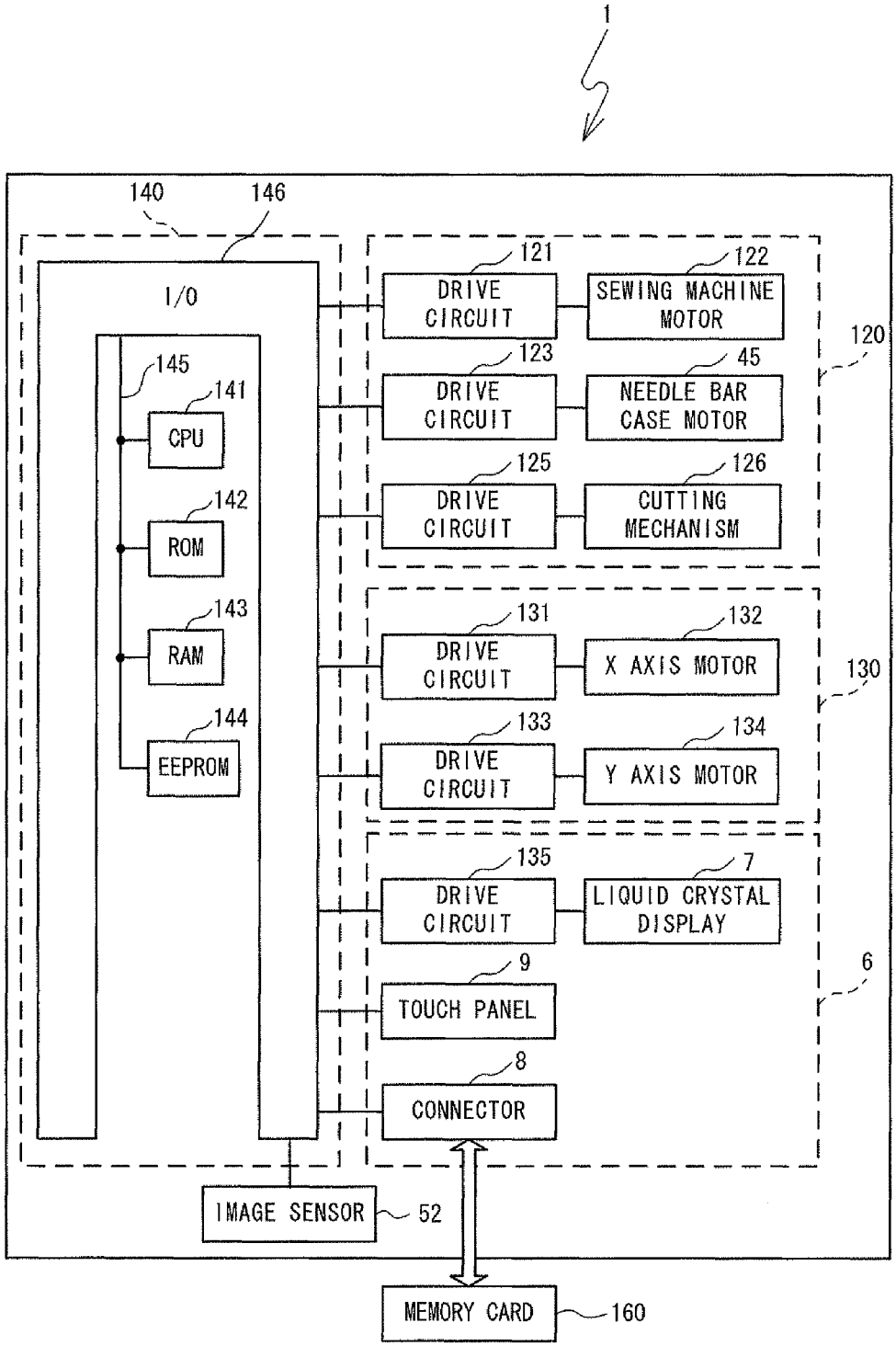
FIG. 8 is a block diagram that shows an electrical configuration of the multi-needle sewing machine.

Next, the electrical configuration of the sewing machine 1 will be explained with reference to FIG. 8. As shown in FIG. 8, the sewing machine 1 includes a needle drive portion 120, a sewn object drive portion 130, the operation portion 6, the image sensor 52, and the control portion 140. The needle drive portion 120, the sewn object drive portion 130, the operation portion 6, and the control portion 140 will each be described in detail below.

The needle drive portion 120 includes the sewing machine motor 122, a drive circuit 121, the needle bar case motor 45, a drive circuit 123, a cutting mechanism 126, and a drive circuit 125. The sewing machine motor 122 moves the needle bars 31 reciprocally up and down. The drive circuit 121 drives the sewing machine 122 in accordance with a control signal from the control portion 140. The needle bar case motor 45 moves the needle bar case 21 to the left and to the right in relation to the body 20 of the sewing machine 1. The drive circuit 123 drives the needle bar case motor 45 in accordance with a control signal from the control portion 140. The cutting mechanism 126 cuts the upper threads 15 (refer to FIG. 1) that are supplied to the needles 35 (refer to FIGS. 2 and 3). The drive circuit 125 drives the cutting mechanism 126 in accordance with a control signal from the control portion 140.

The sewn object drive portion 130 includes the X axis motor 132, a drive circuit 131, the Y axis motor 134, and a drive circuit 133. The X axis motor 132 moves the embroidery frame 39 (refer to FIG. 1) to the left and to the right. The drive circuit 131 drives the X axis motor 132 in accordance with a control signal from the control portion 140. The Y axis motor 134 moves the embroidery frame 39 forward and backward. The drive circuit 133 drives the Y axis motor 134 in accordance with a control signal from the control portion 140.

The operation portion 6 includes the touch panel 9, the connector 8, a drive circuit 135, and the LCD 7. The drive circuit 135 drives the LCD 7 in accordance with a control signal from the control portion 140. The connector 8 can connect to the memory card 160.

The control portion 140 includes a CPU 141, a ROM 142, a RAM 143, an EEPROM 144, and an input/output interface (I/O) 146, all of which are connected to one another by a bus 145. The needle drive portion 120, the sewn object drive portion 130, the operation portion 6, and the image sensor 52 are each connected to the I/O 146. The CPU 141, the ROM 142, the RAM 143, and the EEPROM 144 will be explained in detail below.

The CPU 141 performs main control over the sewing machine 1 and, in accordance with various types of programs that are stored in a program storage area (not shown in the drawings) in the ROM 142, performs various types of computations and processing that relating to sewing. The programs may also be stored in an external storage device such as a flexible disk or the like.

The ROM 142 includes a plurality of storage areas that include the program storage area, although these are not shown in the drawings. Various types of programs for operating the sewing machine 1, including an embroidery program and an image capture program, are stored in the program storage area. The embroidery program is a program for sewing the embroidery pattern on the work cloth (not shown in the drawings) that is held by the embroidery frame 39, in accordance with embroidery data. The image capture program is a program for capturing an image using the image sensor 52. The RAM 143 is a storage element that can be read from and written to as desired, and storage areas that store computation results and the like from computational processing by the CPU 141 are provided in the RAM 143 as necessary. The EEPROM 144 is a storage element that can be read from and written to as desired, and various types of parameters for the sewing machine 1 to perform various types of processing are stored in the EEPROM 144.

Figure 9:
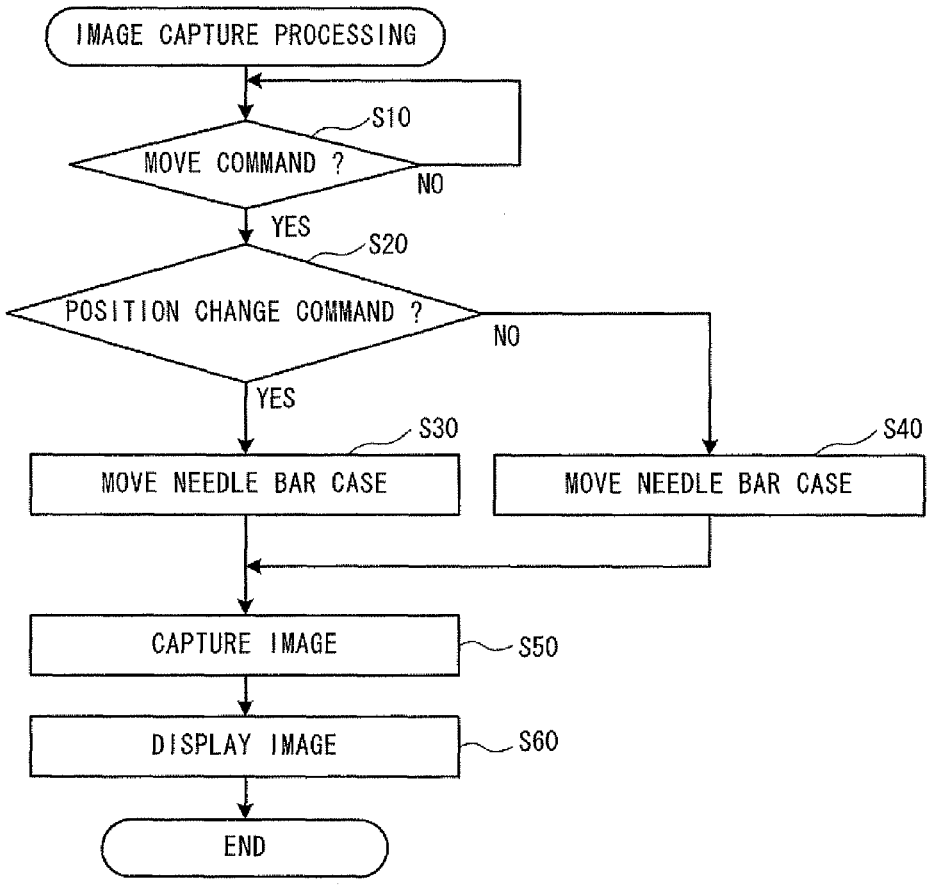
FIG. 9 is a flowchart of image capture processing.

Image capture processing according to the first embodiment will be explained with reference to FIGS. 9 to 15. In the image capture processing, the sewing machine 1 according to the first embodiment displays on the LCD 7 an image that is represented by image data that have been generated by the image sensor 52. The image capture processing that is shown in FIG. 9 is started in a case where a start command has been input. The start command may be input by the panel operation, for example. The image capture processing that is shown in FIG. 9 is performed by the CPU 141 that is shown in FIG. 8, in accordance with the image capture program that is stored in the ROM 142 that is shown in FIG. 8. In order to simplify the explanation, it will be assumed that in the image capture processing in each of the first to third embodiment, the needle bar case 21 is in the sewing position (a first position) when the image capture processing starts.

Figure 10:
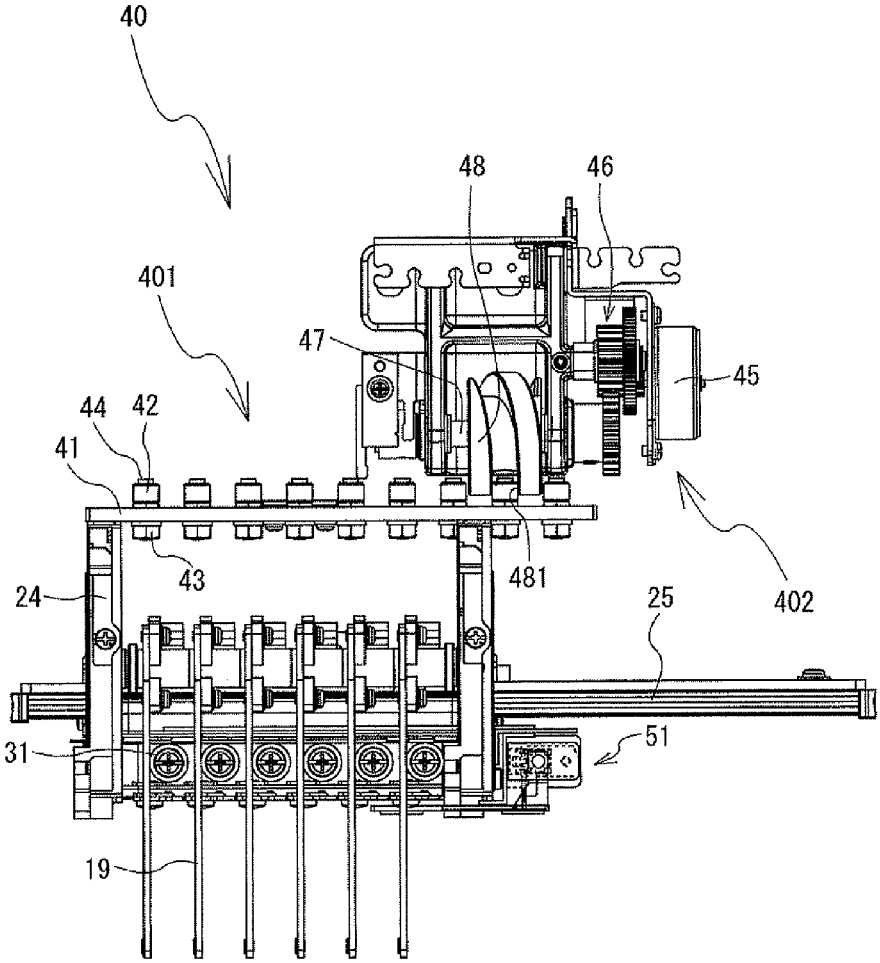
FIG. 10 is a plan view of the needle bar case moving mechanism in a case where an engaging roller that is second from the right is engaged with the positioning portion of the helical cam.
Figure 11:
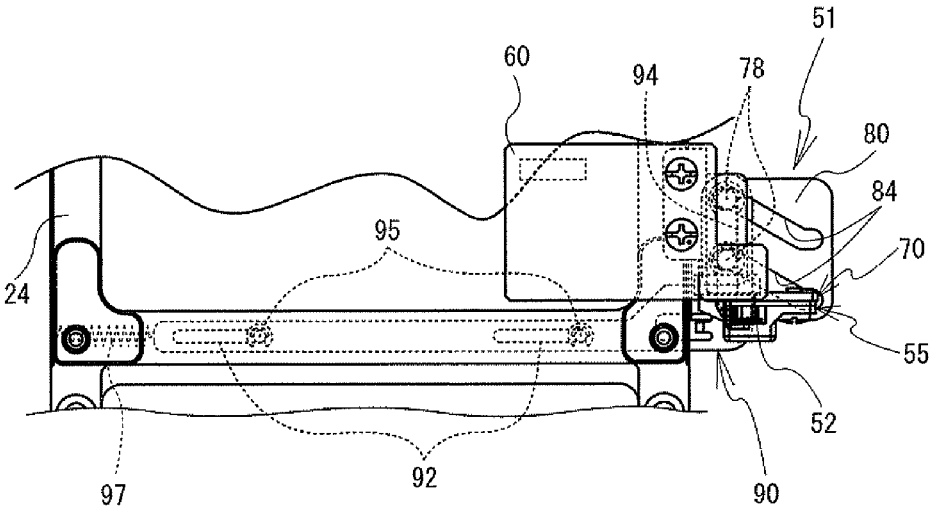
FIG. 11 is a front view of an image sensor holding mechanism in a case where the needle bar case is in the position in FIG. 10.
Figure 12:
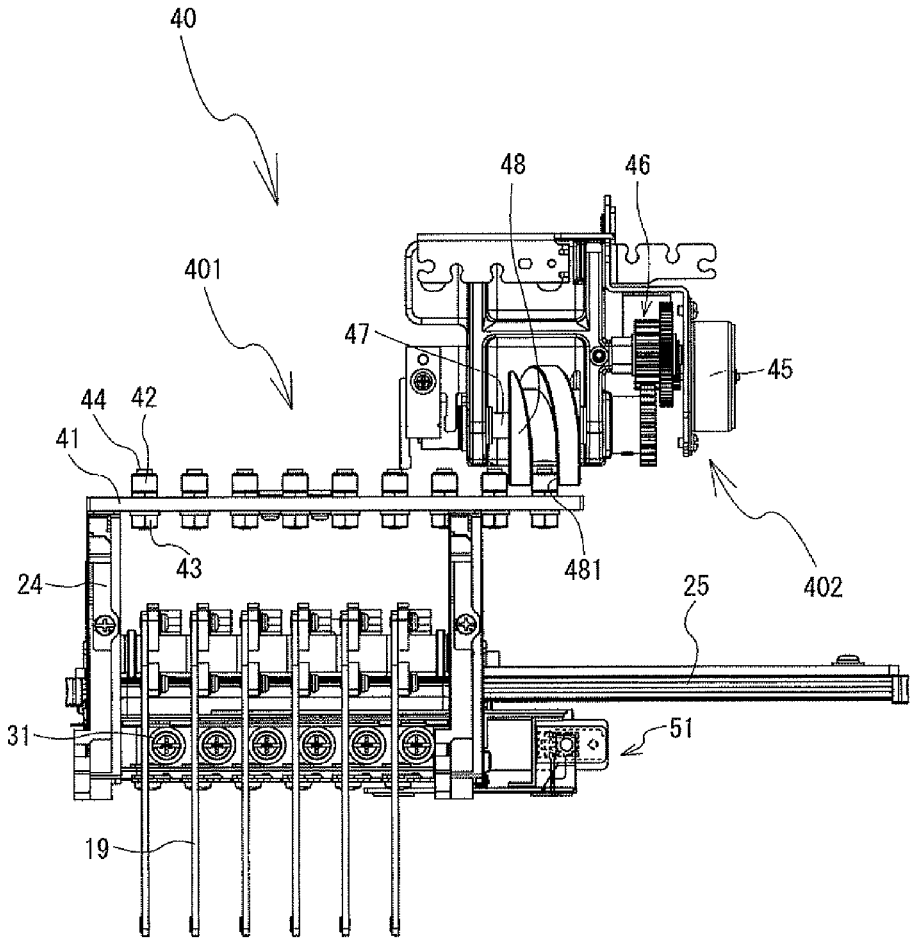
FIG. 12 is a plan view of the needle bar case moving mechanism in a case where a rightmost engaging roller is engaged with the positioning portion of the helical cam.
Figure 13:
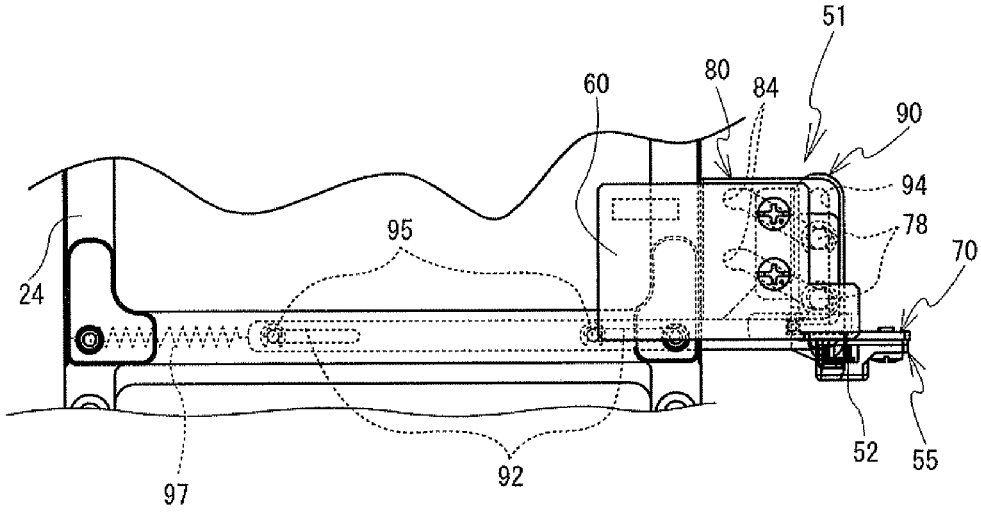
FIG. 13 is a front view of the image sensor holding mechanism in a case where the needle bar case is in the position in FIG. 12.

First, an overview of the image capture processing according to the first embodiment will be explained. The sewing machine 1 according to the first embodiment is adapted to switch the image capture position to one of a normal position and a zoom position by changing the position of the needle bar case 21 in the left-right direction. In the vertical direction, the normal position is the position that is shown in FIG. 11. The zoom position is a position of the image sensor 52 that is lower than the normal position in the vertical direction. In the sewing machine 1 according to the first embodiment, the position of the image sensor 52 in the horizontal direction, in both the normal position and the zoom position, is a position in which the image sensor 52 is located directly above the needle hole 38 (refer to FIG. 1). In a case where the image capture position is set to the normal position, the sewing machine 1, as shown in FIG. 10, moves the needle bar case 21 to a position (hereinafter simply called the position in FIG. 10) where the engaging roller 42 that is the second from the right engages the positioning portion 481 of the helical cam 48. In a case where the image capture position is set to the zoom position, the sewing machine 1, as shown in FIG. 12, moves the needle bar case 21 to a position (hereinafter simply called the position in FIG. 12) where the engaging roller 42 that is the farthest to the right engages the positioning portion 481 of the helical cam 48. The image capture position is selected by the user and is input by the panel operation as a part of a move command. The move command is a command that moves the image sensor 52 to the selected image capture position.

The image capture processing in FIG. 9 will be explained in more detail. As shown in FIG. 9, in the image capture processing, first, a determination is made as to whether the move command has been acquired (Step S10). Whether the move command has been acquired may be determined, for example, according to whether the user has input the move command by the panel operation. In a case where the move command has not been acquired (NO at Step S10), the CPU 141 waits until the move command is acquired. In a case where the move command has been acquired (YES at Step S10), a determination is made as to whether the move command that has been acquired at Step S10 is a position change command (Step S20). In a case where the image capture position that is included in the move command that has been acquired at Step S10 is the zoom position, a determination is made that the move command that has been acquired at Step S10 is a position change command (YES at Step S20).

In a case where the move command that has been acquired at Step S10 is not the position change command (NO at Step S20), the needle bar case 21 is moved to the position in FIG. 10 (Step S40). More specifically, a control signal is output to the drive circuit 123, and the needle bar case motor 45 is driven such that the position of the needle bar case 21 (the frame 24) becomes the position in FIG. 10. In a case where the needle bar case 21 is at the position in FIG. 10 (the third position), the projecting portion 98 of the guide plate 90 and the projecting portion 49 of the body 20 (refer to FIG. 5) are in contact with one another. In a case where the needle bar case 21 is at the position in FIG. 10, the pins 78 of the sensor base plate 70 are at the left ends of the guide holes 84 of the cam plate 80, as shown in FIG. 11. Of the two pins 78, the pin 78 on the upper side is at the upper end of the guide hole 94. In a case where the needle bar case 21 is at the position in FIG. 10, the position of image sensor 52 in the vertical direction is the normal position.

In contrast, in a case where the move command that has been acquired at Step S10 is a position change command (YES at Step S20), the needle bar case 21 is moved to the position in FIG. 12 (a second position) (Step S30). More specifically, a control signal is output to the drive circuit 123 (refer to FIG. 8), and the needle bar case motor 45 is driven such that the position of the frame 24 in relation to body 20 becomes the position in FIG. 12. In a case where the needle bar case 21 is at the position in FIG. 12, the pins 78 of the sensor base plate 70 are at the right ends of the guide holes 84. Of the two pins 78, the pin 78 on the lower side is at the lower end of the guide hole 94. In a case where the needle bar case 21 is at the position in FIG. 12, the position of image sensor 52 in the vertical direction is the zoom position.

The operation of the holding mechanism 51 at Step S30 will be explained. In a case where the needle bar case 21 is at the position in FIG. 10, the projecting portion 98 of the guide plate 90 is in contact with the projecting portion 49 that is provided in the interior of the arm 4 (refer to FIG. 5). When the needle bar case 21 is moved farther to the left than the position in FIG. 10, the movement of the guide plate 90 in the direction in which the needle bar case 21 is moved is restricted by the projecting portion 49, such that the guide plate 90 slides to the right (in the horizontal direction) in relation to the needle bar case 21. In contrast to this, because the cam plate 80 is secured to the right side face of the frame 24, the cam plate 80 moves together with the needle bar case 21, even when the positional relationship between the needle bar case 21 and the guide plate 90 is changed. When the guide plate 90 slides in relation to the needle bar case 21, the pins 78 of the sensor base plate 70 are guided in the guide holes 84 of the can plate 80 and are moved downward, even as the horizontal positions of the pins 78 in relation to the body 20 remain fixed. As described previously, the holding mechanism 51 moves the image sensor 52 in the vertical direction in relation to the needle bar case 21 in conjunction with the movement of the needle bar case 21. The operation of the holding mechanism 51 in a case where the needle bar ease 21 is moved from the position in FIG. 12 to the position in FIG. 10 is the opposite of the operation in the case where the needle bar case 21 is moved from the position in FIG. 10 to the position in FIG. 12.

Figure 14:
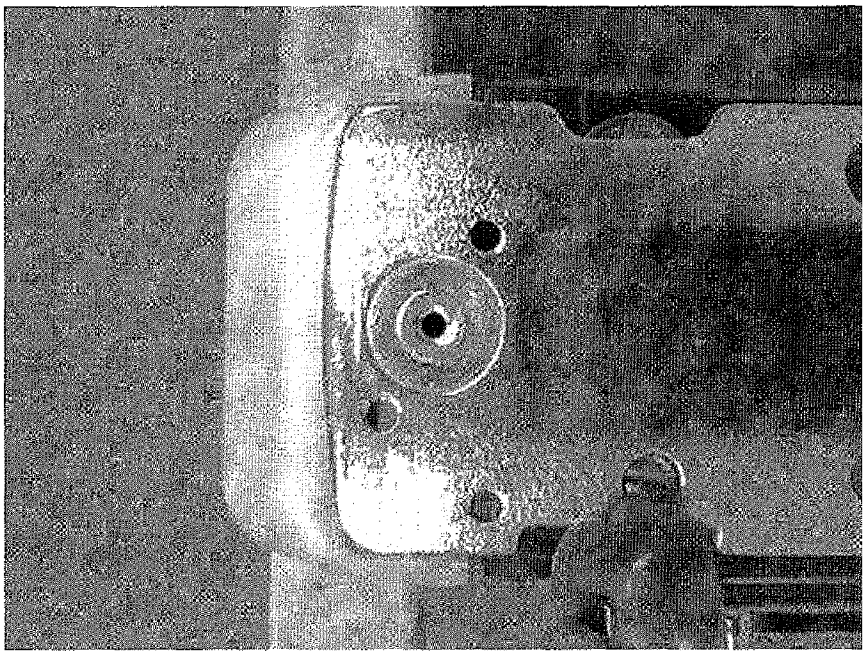
FIG. 14 is an explanatory figure of an image that has been captured by the image sensor when the image sensor is disposed in a normal position.
Figure 15:
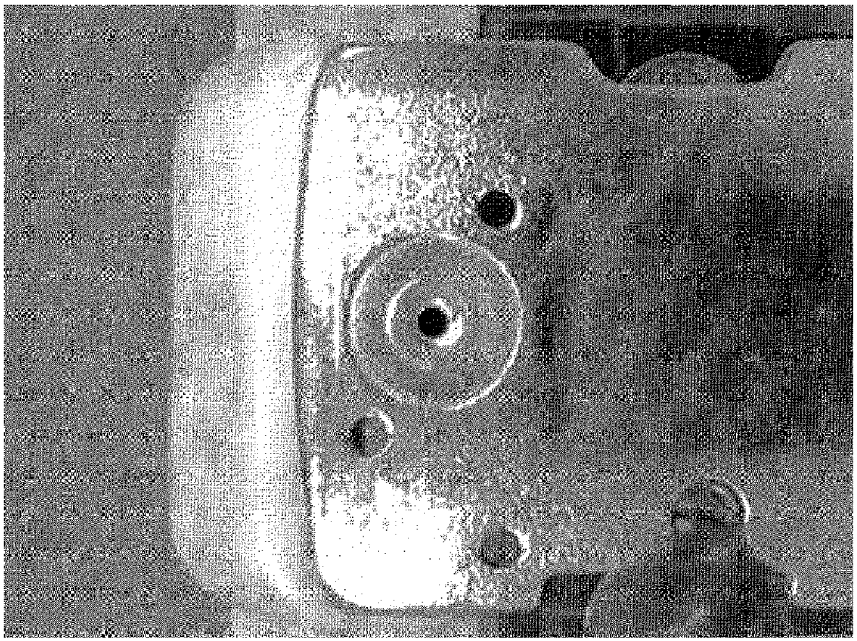
FIG. 15 is an explanatory figure of an image that has been captured by the image sensor when the image sensor is disposed in a zoom position.

Following whichever of Step S30 and Step S40 is performed, an image of the area around the needle drop point is captured by the image sensor 52 at a specified timing, and the generated image data are stored in the RAM 143 (Step S50). The specified timing may be, for example, the timing at which a command is input by the panel operation. Next, the image that is represented by the image data that have been generated at Step S50 is displayed on the LCD 7 (Step S60). In a case where the needle bar case 21 has moved at Step S40 to a position that corresponds to the normal position, the image that is shown in FIG. 14, for example, is displayed on the LCD 7. In a case where the needle bar case 21 has moved at Step S30 to a position that corresponds to the zoom position, the image that is shown in FIG. 15, for example, is displayed on the LCD 7. A comparison of FIG. 14 and FIG. 15 shows that the needle hole 38 appears larger in FIG. 15. Following Step S60, the image capture processing is terminated.

In the sewing machine 1 according to the first embodiment that has been explained above, it is possible to move the image sensor 52 in relation to the needle bar case 21 in accordance with the move command that is acquired at Step S10 in FIG. 9. Therefore, by inputting the move command, the user can change the position of the image sensor 52 in the vertical direction and can acquire images with different fields of view before and after the moving, particularly images that differ in their scale ratio. The sewing machine 1 can move the image sensor 52 in relation to the needle bar case 21 in conjunction with the moving of the needle bar case 21. Therefore, the sewing machine 1 does not require a dedicated drive source for moving the image sensor 52. In other words, the sewing machine 1 can provide a configuration for a moving device for moving the image sensor 52 that is simpler than the configuration in a case where the moving device is provided separately from the needle bar case moving mechanism 40. By moving the needle bar case 21 to a position that is one of the position that is shown in FIG. 10 and the position that is shown in FIG. 12, the sewing machine 1 can change the position of the image sensor 52 in the vertical direction by the sensor base plate 70, the cam plate 80, and the guide plate 90. The comparatively simple configuration makes it possible for the sewing machine 1 to utilize the movement of the needle bar case 21 to change the position of the image sensor 52 in the vertical direction.

In the first embodiment, the position at which the image sensor 52 is disposed directly above the needle hole 38 is defined as the image capture position. Accordingly, there is less distortion in the image that is acquired by the image capture at Step S50 than in a case where an image is captured from a position that is diagonally above the needle drop point. Therefore, the user can easily recognize the needle drop point based on the image that is displayed on the LCD 7 at Step S60. Furthermore, because the distortion of the image that is captured at Step S50 is small, there is also small distortion in the coordinates within the image. Therefore, in a case where the sewing machine 1 determines a specified position within the image, such as the needle drop point or the like, for example, the sewing machine 1 can compute (the coordinates of) the specified position precisely.

A sewing machine 1 according to a second embodiment will be explained. The sewing machine 1 according to the second embodiment changes an image capture direction of the image sensor 52 in conjunction with the moving of the needle bar case 21. In the configuration of the sewing machine 1 according to the second embodiment, the cover 23 and the holding mechanism 51 are different from the first embodiment, while the other structural elements are the same as in the first embodiment. The electrical configuration of the sewing machine 1 according to the second embodiment is the same as that of sewing machine 1 according to the first embodiment. Accordingly, explanations of the structures that are the same as in the sewing machine 1 according to the first embodiment will be omitted, and the structural elements that are different from those in the sewing machine 1 according to the first embodiment will hereinafter be explained. In the drawings that are hereinafter described, the same reference numerals are assigned to the structures that are the same as in the sewing machine 1 according to the first embodiment.

In the sewing machine 1 according to the second embodiment, in image capture processing that will be described later, the image capture direction of the image sensor 52 can be set to one of facing downward and facing forward. Facing downward refers to a case in which the object of the image capture is located below the lens (not shown in the drawings) of the image sensor 52. Facing forward refers to a case in which the object of the image capture is located in front of the lens (not shown in the drawings) of the image sensor 52. A portion of the front face of the cover 23 of the sewing machine 1 according to the second embodiment is made of transparent plastic, such that the image sensor 52 can capture an image of the outside of the cover 23 in a case where the image capture direction of the image sensor 52 has been set to facing forward.

An image sensor holding mechanism 251 (hereinafter simply called the holding mechanism 251) according to the second embodiment will be explained with reference to FIGS. 16 and 17. In the explanation that follows, in FIG. 16, the right side, the left side, the front side, and the rear side of the page respectively indicate the right side, the left side, the front side, and the rear side of the sewing machine 1. In FIG. 17, the lower left side, the upper right side, the upper left side, and the lower right side of the page respectively indicate the front side, the rear side, the left side, and the right side of the sewing machine 1.

Figure 16:
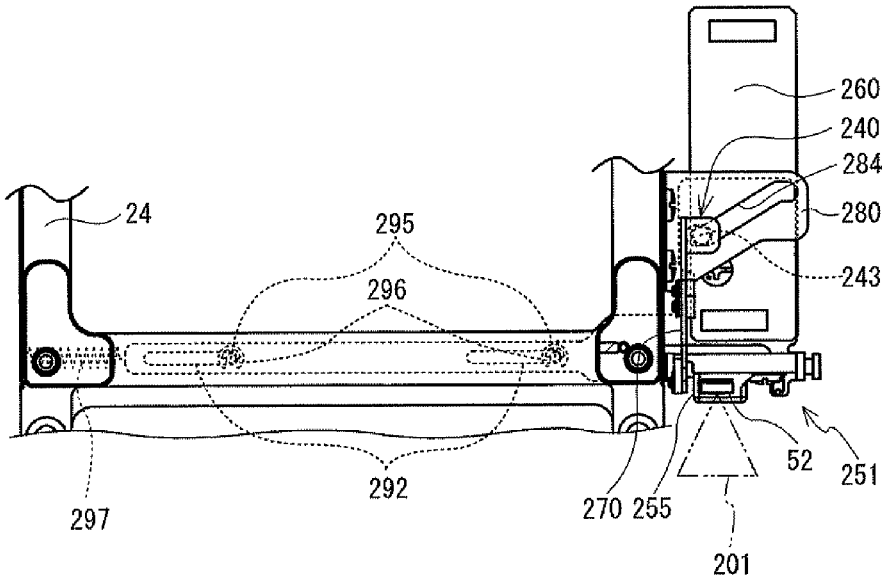
FIG. 16 is a front view of the image sensor holding mechanism when an image capture direction has been set to facing downward.
Figure 17:
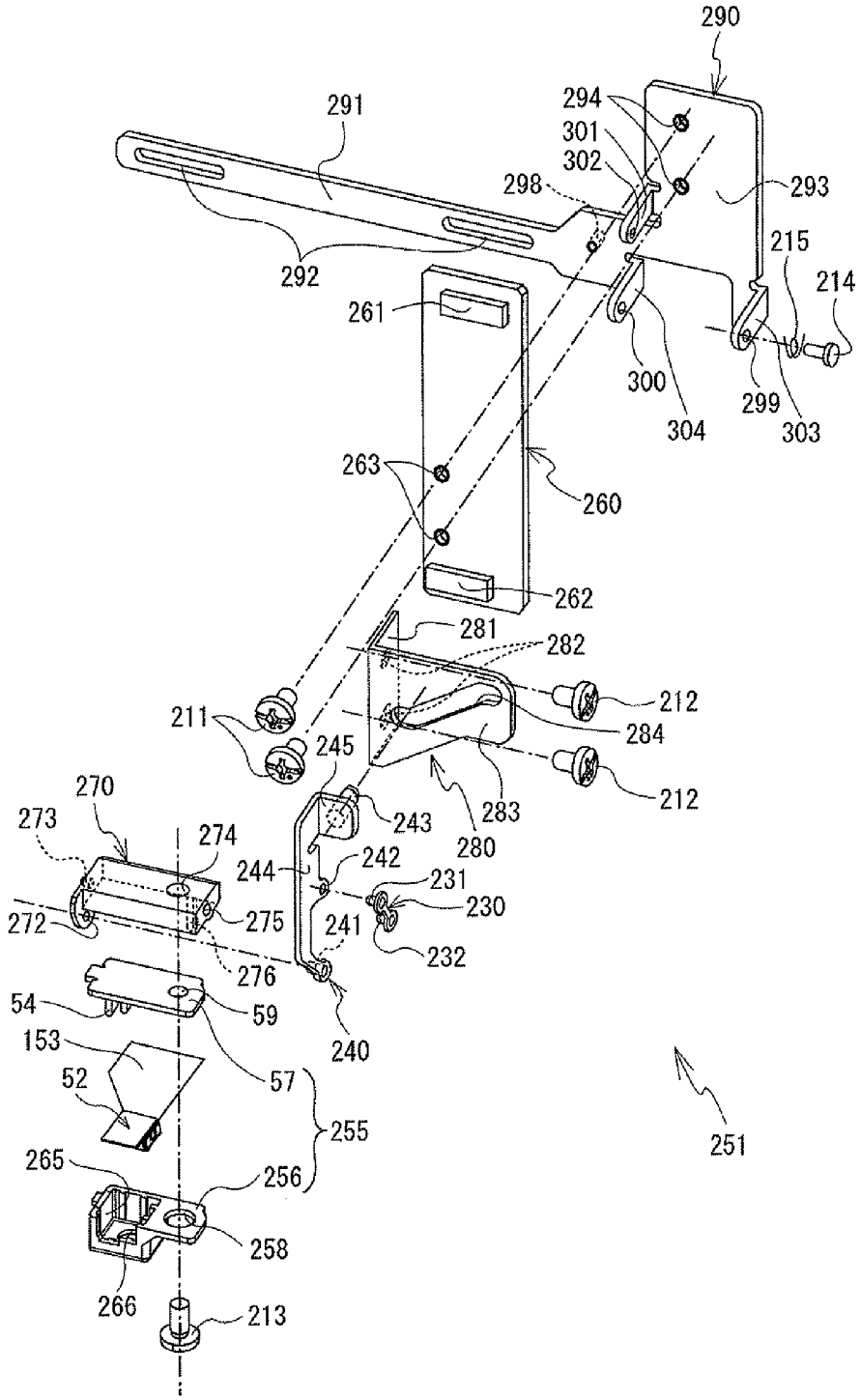
FIG. 17 is an oblique exploded view of the image sensor holding mechanism.

As shown in FIG. 16, the holding mechanism 251 is attached to the lower portion of the right side face of the frame 24. The holding mechanism 251 supports the image sensor 52 such that the image sensor 52 can move in the left-right direction (the horizontal direction) in relation to the needle bar case 21. As shown in FIGS. 16 and 17, the holding mechanism 251 includes the image sensor 52, a sensor holder 255, a connecting plate 260, a sensor link member 270, an actuating link member 240, a driven link member 230, a cam plate 280, and a guide plate 290. The sensor link member 270, the actuating link member 240, the driven link member 230, and the guide plate 290 configure a four-bar (four-joint) parallel linkage. Hereinafter, the structural elements with which the holding mechanism 251 is provided will be explained in detail. The explanations of members that are the same as in the sewing machine 1 according to the first embodiment will be simplified.

The image sensor 52 is the same as in the first embodiment. As shown in FIG. 17, the sensor holder 55 includes a sensor support portion 256 and the sensor cover 57 that is the same as the first embodiment. A box-shaped recessed portion 265 is provided in the left portion of the sensor support portion 256. A circular opening 266 is provided in the bottom face of the recessed portion 265. A hole 258, into which a screw 213 is inserted, is provided in the right portion of the sensor support portion 256. The image sensor 52 is inserted into the recessed portion 265 of the sensor support portion 256 such that a lens (not shown in the drawings) faces downward and the image sensor 52 is held between the sensor support portion 256 and the sensor cover 57.

The connecting plate 260 is a plate that has a rectangular shape when viewed from the front, and the connecting plate 260 electrically connects the image sensor 52 and the control portion 140 (refer to FIG. 8) of the sewing machine 1. The connecting plate 260 is provided with the connector 262 that is electrically connected to the image sensor 52 and with a connector 261 that is electrically connected to the control portion 140 (refer to FIG. 8) of the sewing machine 1. Two screw holes 263 are provided in the lower left portion of the connecting plate 260, one above the other.

The sensor link member 270 has a rectangular shape in a plan view and has a box shape that has an opening on the bottom side. The sensor link member 270 accommodates the sensor holder 255 with the lens (not shown in the drawings) of the image sensor 52 facing toward the opening 266. A screw hole 275 into which a screw 214 is inserted is provided on the right side face of the sensor link member 270. A cylindrical pin 273 is provided on the left side face of the sensor link member 270. The pin 273 is inserted into a hole 300 in the guide plate 290, which will be described later. A positioning member 276 is provided on the lower portion of the rear face of the sensor link member 270. The positioning member 276 is a plate member that is long in the up-down direction. In a case where the image capture direction of the image sensor 52 is facing downward, the positioning member 276 determines the position of the sensor link member 270 in relation to the guide plate 290, which will be described later. A hole 272 is provided in the lower portion of the left side face of the sensor link member 270. A pin 241 of the actuating link member 240, which will be described later, is inserted into the hole 272. A screw hole 274 is provided in the right portion of the top face of the sensor link member 270. The sensor holder 255 is secured to the sensor link member 270 by the screw 213, which passes through the hole 258 and the screw hole 59 of the sensor holder 255 and through the screw hole 274 of the sensor link member 270.

The actuating link member 240 includes a link portion 244 and a pin support portion 245. The link portion 244 is a plate member that is long in the up-down direction. A hole 242, into which is inserted a pin 231 of the driven link member 230, which will be described later, is provided in the link portion 244 in a central position in the up-down direction. The cylindrical pin 241, which projects toward the left, is provided in the lower portion of the left side face of the link portion 244. The pin 241 is inserted into the hole 272 in the sensor link member 270. The pin support portion 245 has a rectangular shape in a front view, and the pin support portion 245 extends orthogonally to the right from the upper end of the link portion 244. A cylindrical pin 243 that projects toward the rear is provided on the rear face of the pin support portion 245.

The driven link member 230 has a roughly rectangular shape when viewed from the right side. The cylindrical pin 231 and a cylindrical pin 232, which project to the left, are provided on the left side face of the driven link member 230. The pin 231 is inserted into the hole 242 in the actuating link member 240. The pin 232 is inserted into a hole 302 in the guide plate 290, which will be described later.

The cam plate 280 may be formed by bending a rectangular plate at a right angle, and the cam plate 280 includes a face 281 that extends in the front-to-rear direction and a face 283 that extends at a right angle to the right from the front edge of the face 281. Two holes 282 are provided in the face 281, one above the other. The cam plate 280 is secured to the right side face of the frame 24 by screws 212 that are inserted into the holes 282, respectively. The guide hole 284 is provided in the face 283 and is slanted in relation to the direction of movement of the needle bar case 21 (the horizontal direction). The pin 243 of the actuating link member 240 is inserted into the guide hole 284.

The guide plate 290 is L-shaped in a front view, and the guide plate 90 includes a slide portion 291 and a support portion 293. The slide portion 291 is a plate member that is long in the left-right direction. Two guide holes 292 are provided in the slide portion 91 in the left-right direction. The guide holes 292 are elongated holes that are long in the left-right direction. As shown in FIG. 16, positioning pins 295 that are press fitted into the frame 24 are inserted into the guide holes 292. The rear ends of the positioning pins 295 that are inserted into the guide holes 292 are secured by retaining rings 296. The guide plate 290 is supported on the frame 24 by the positioning pins 295 such that the guide plate 290 can slide in the left-right direction (the horizontal direction) in relation to the frame 24. One end of a spring 297 is attached to the left end of the slide portion 291. The other end of the spring 297 is secured to the frame 24, and the guide plate 290 is urged by the spring 297 toward the left side of the sewing machine 1.

The support portion 293 of the guide plate 290 extends upward from the right end of the slide portion 291. The support portion 293 functions as a fixed link in the four-bar parallel linkage. Two screw holes 294 are provided in the upper portion of the support portion 293, one above the other. The connecting plate 260 is secured to the front face of the guide plate 290 by screws 211 that pass through the screw holes 263 in the connecting plate 260 and the screw holes 294 in the guide plate 290. A plate-shaped support portion 301 that projects toward the front is provided on the left edge of the support portion 293 in a central position in the up-down direction. The hole 302 is provided at the front end side of the support portion 301. The pin 232 of the driven link member 230 is inserted into the hole 302. A plate-shaped support portion 303 that projects toward the front is provided on the lower right edge of the support portion 293. A hole 299, into which the screw 214 is inserted, is provided at the front end side of the support portion 303. A plate-shaped support portion 304 that projects toward the front is provided on the lower left edge of the support portion 293. The hole 300, into which the pin 273 of the sensor link member 270 is inserted, is provided at the front end side of the support portion 304. The sensor link member 270 is rotatably supported by the screw 214 and the pin 273. A torsion spring 215 is attached to the screw 214. The sensor link member 270, which is supported by the screw 214 and the pin 273, is urged by the torsion spring 215 toward the counterclockwise direction as viewed from the right side. A projecting portion 298 that projects toward the rear is provided on the rear face of the support portion 293. In a case where the needle bar case 21 has been moved to the position in FIG. 10 that is the same as in the first embodiment, the projecting portion 298 is in contact with the projecting portion 49 (refer to FIG. 18) that is provided in the interior of the arm 4.

Figure 19:
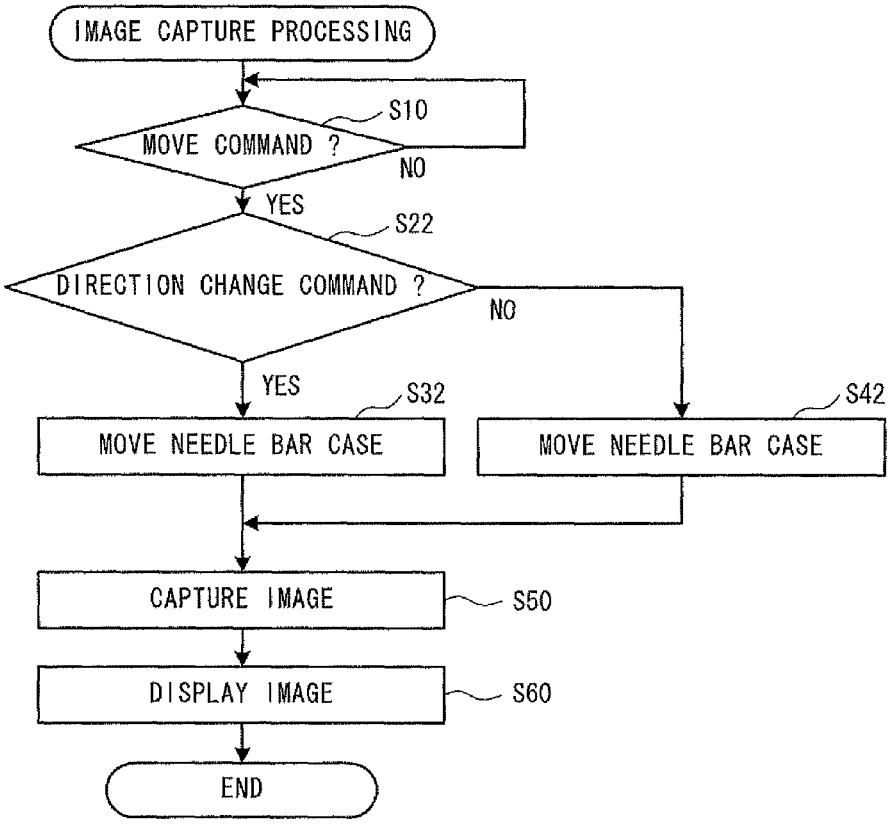
FIG. 19 is a flowchart of image capture processing according to a second embodiment.

Image capture processing according to the second embodiment will be explained with reference to FIG. 19. In the image capture processing, the sewing machine 1 according to the second embodiment displays on the LCD 7 an image that is represented by the image data that have been generated by the image sensor 52. The image capture processing that is shown in FIG. 19 is started in a case where the start command has been input, in the same manner as in the first embodiment. The image capture processing that is shown in FIG. 19 is performed by the CPU 141 that is shown in FIG. 8, in accordance with the image capture program that is stored in the ROM 142. Note that in FIG. 19, the steps where the same processing is performed that is performed in the image capture processing according to the first embodiment that is shown in FIG. 9 are assigned the same step numbers. Explanations of the steps that are the same as in the image capture processing according to the first embodiment that is shown in FIG. 9 will be omitted or simplified.

First, an overview of the image capture processing according to the second embodiment will be explained. The sewing machine 1 according to the second embodiment is adapted to switch the image capture direction to one of facing downward and facing forward. Both when the image capture direction is set to facing downward and when the image capture direction is set to facing forward, the position of the image sensor 52 in the horizontal direction is the same. The sewing machine 1 according to the second embodiment sets the position of the image sensor 52 in the horizontal direction to a position in which the image sensor 52 is disposed directly above the needle hole 38 (refer to FIG. 1). In a case where the sewing machine 1 sets the image capture direction of the image sensor 52 to facing downward, the sewing machine 1 moves the needle bar case 21 to the position in FIG. 10 according to the first embodiment. In a case where the sewing machine 1 sets the image capture direction of the image sensor 52 to facing forward, the sewing machine 1 moves the needle bar case 21 to the position in FIG. 12 that is the same as in the first embodiment. The image capture direction is selected by the user and is input by the panel operation as a part of the move command.

The image capture processing in FIG. 19 will be explained in more detail. As shown in FIG. 19, in the image capture processing according to the second embodiment, a determination is made as to whether the move command that has been acquired at Step S10 (YES at Step S10) is a direction change command (Step S22). In a case where the image capture direction that is included in the move command that has been acquired at Step S10 is the facing forward direction, a determination is made that the move command that has been acquired at Step S10 is a direction change command (YES at Step S22).

Figure 18:
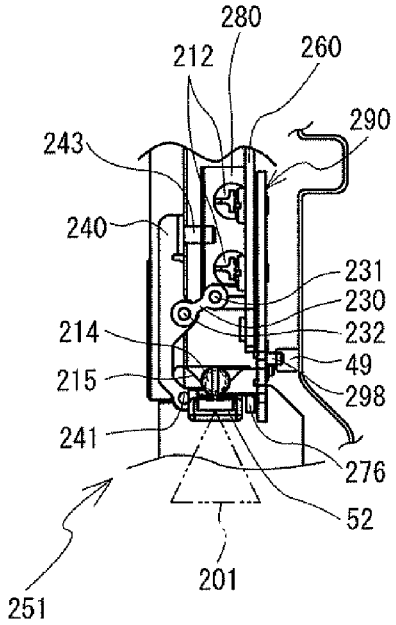
FIG. 18 is a right side view of the image sensor holding mechanism when the image capture direction has been set to facing downward.
Figure 20:
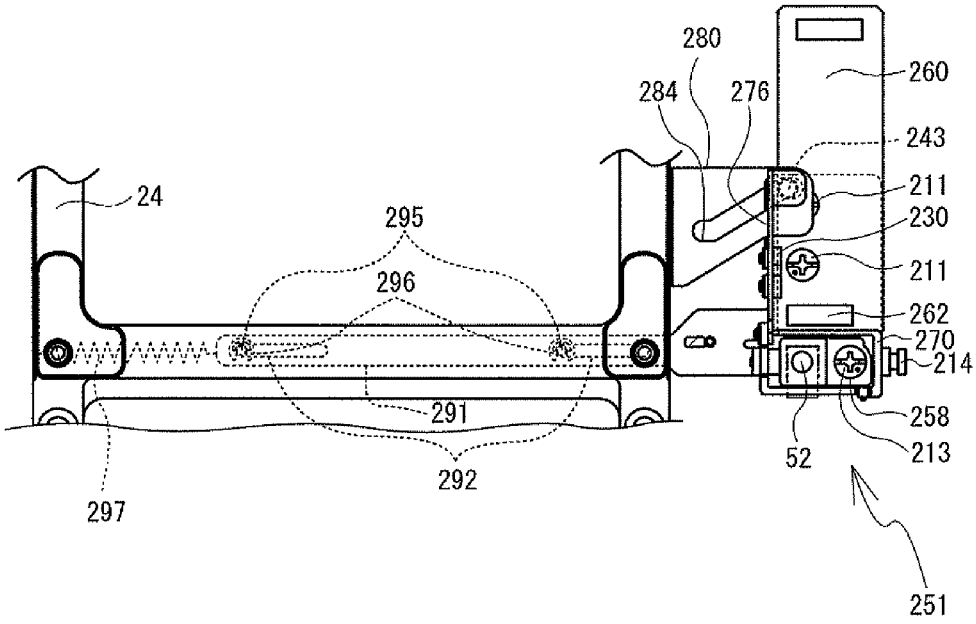
FIG. 20 is a front view of the image sensor holding mechanism when the image capture direction has been set to facing forward.
Figure 21:
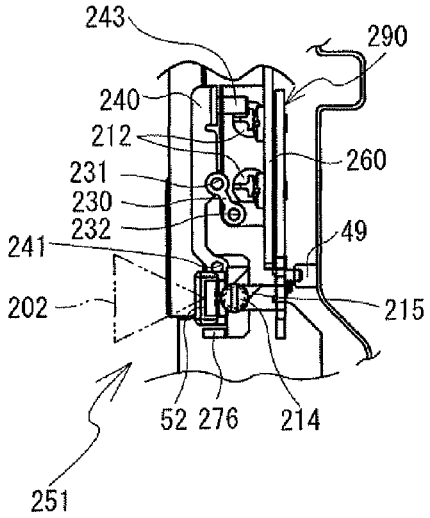
FIG. 21 is a right side view of the image sensor holding mechanism when the image capture direction has been set to facing forward.

In a case where the move command that has been acquired at Step S10 is not a direction change command (NO at Step S22), the needle bar case 21 is moved to the position that corresponds to the facing downward direction (Step S42). More specifically, a control signal is output to the drive circuit 123, and the needle bar case motor 45 is driven such that the position of the needle bar case 21 (the frame 24) becomes the position that is shown in FIG. 10. In a case where the needle bar case 21 is at the position in FIG. 10 (the third position), the pin 243 of the actuating link member 240 is positioned at the left end of the guide hole 284 of the cam plate 280, as shown in FIG. 16. Furthermore, as shown in FIG. 18, an image capture direction 201 of the image sensor 52 is the facing downward direction. In contrast, in a case where the move command that has been acquired at Step S10 is a direction change command (YES at Step S22), the needle bar case 21 is moved to the position in FIG. 12 (Step S32). More specifically, a control signal is output to the drive circuit 123 (refer to FIG. 8), and the needle bar case motor 45 is driven such that the position of the needle bar case 21 (the frame 24) in relation to body 20 becomes the position in FIG. 12. In a case where the needle bar case 21 is at the position in FIG. 12 (the second position), the pin 243 of the actuating link member 240 is positioned at the right end of the guide hole 284 of the cam plate 280, as shown in FIG. 20. Furthermore, as shown in FIG. 21, an image capture direction 202 of the image sensor 52 is the facing forward direction.

The operation of the holding mechanism 251 at Step S32 will be explained. In the same manner as in the sewing machine 1 according to the first embodiment, in a case where the needle bar case 21 is at the position in FIG. 10, the projecting portion 298 of the guide plate 290 is in contact with the projecting portion 49 that is provided in the interior of the arm 4 (refer to FIG. 18). When the needle bar case 21 is moved farther to the left than the position in FIG. 10, the movement of the guide plate 290 in the direction in which the needle bar case 21 is moving is restricted by the projecting portion 49, such that the guide plate 290 slides to the right (in the horizontal direction) in relation to the needle bar case 21. In contrast to this, the cam plate 280, because the cam plate 280 is secured to the right side face of the frame 24, moves together with the needle bar case 21, even when the needle bar case 21 is moved farther to the left than the position in FIG. 10. When the guide plate 290 slides in relation to the needle bar case 21, the pin 243 of the actuating link member 240 is guided in the guide hole 284 of the cam plate 280 and is moved upward, even as the horizontal position of the pin 243 in relation to the body 20 remains fixed. In conjunction with the actuating link member 240 being moved upward, the sensor link member 270, which is coupled to the actuating link member 240, is rotated ninety degrees in the clockwise direction as seen from the right side, with the screw 214 and the pin 273 serving as the axis of rotation. The angle of rotation of the image sensor 52 (the sensor link member 270) is determined in accordance with the link ratio of the four-bar parallel linkage and the amount of movement of the pin 243 in relation to the guide plate 290. The amount of movement of the pin 243 in relation to the guide plate 290 is determined in accordance with the slope of the guide hole 284 and the distance that the guide plate 290 slides in relation to the needle bar case 21. As described previously, the holding mechanism 251 changes the image capture direction of the image sensor 52 in conjunction with the movement of the needle bar case 21. In a case where the needle bar case 21 is moved from the position in FIG. 12 to the position in FIG. 10, the image sensor 52 (the sensor link member 270) is rotated ninety degrees in the counterclockwise direction as seen from the right side, which is the opposite of the case where the needle bar case 21 is moved from the position in FIG. 10 to the position in FIG. 12. The sensor link member 270 is urged by the torsion spring 215 toward the counterclockwise direction as seen from the right side, and in a case where the image capture direction is the facing downward direction, the positioning member 276 is pressed against the guide plate 290.

Following whichever of Step S32 and Step S42 is performed, an image is captured by the image sensor 52 at a specified timing (Step S50). Next, an image is displayed on the LCD 7, based on the image data that have been generated by the image sensor 52 at Step S50 (Step S60). In a case where the needle bar case 21 has been moved to the position in FIG. 10 at Step S42, the image that is shown in FIG. 14, for example, is displayed on the LCD 7. In a case where the needle bar case 21 has been moved to the position in FIG. 12 at Step S32, an image of the face of the user of the sewing machine 1, for example, may be captured by the image sensor 52, and the image that is represented by the generated image data is displayed on the LCD 7. Following Step S60, the image capture processing is terminated.

In the sewing machine 1 according to the second embodiment that has been explained above, it is possible to move the image sensor 52 in relation to the needle bar case 21 in accordance with the move command that is acquired at Step S10 in FIG. 19 (Step S32, Step S42). By inputting the move command, the user can change the image capture direction of the image sensor 52 and can acquire images with different fields of view before and after the moving, particularly images for which the image capture directions are different. The sewing machine 1 can change the image capture direction of the image sensor 52 by moving the image sensor 52 in relation to the needle bar case 21 in conjunction with the moving of the needle bar case 21. Therefore, the sewing machine 1 does not require a dedicated drive source for changing the image capture direction of the image sensor 52. In other words, the sewing machine 1 can provide a configuration for a moving device for changing the image capture direction of the image sensor 52 that is simpler than the configuration in a case where the moving device is provided separately from the needle bar case moving mechanism 40. The sewing machine 1 includes the sensor link member 270, the actuating link member 240, the driven link member 230, the cam plate 280, and the guide plate 290 as coupling members. The use of the coupling members that have a comparatively simple configuration makes it possible for the sewing machine 1 to change the image capture direction of the image sensor 52.

A sewing machine 1 according to the third embodiment will be explained. The sewing machine 1 according to the third embodiment changes one of the position in the vertical direction and the image capture direction of the image sensor 52 in conjunction with the moving of the needle bar case 21. Specifically, the sewing machine 1 according to the third embodiment is adapted to set one of three conditions below as an image capture condition that combines the image capture direction and the image capture position. The first condition defines the image capture direction as the facing downward direction and the position in the vertical direction as the normal position. The second condition defines the image capture direction as the facing downward direction and the position in the vertical direction as the zoom position. The third condition defines the image capture direction as the facing forward direction and the position in the vertical direction as the zoom position. The position of the image sensor 52 in relation to the body 20 in the horizontal direction is the same for the first condition to the third condition.

In the physical configuration of the sewing machine 1 according to the third embodiment, the cover 23, the slide rail 25, the needle bar case moving mechanism 40, and the holding mechanism 51 are different from the first embodiment, while the other structural elements are the same as in the first embodiment. Further, the cover 23 is the same as in the second embodiment. The electrical configuration of the sewing machine 1 according to the second embodiment is the same as that of sewing machine 1 according to the first embodiment. Accordingly, explanations of the structures that are the same as in the sewing machine 1 according to one of the first embodiment and the second embodiment will be omitted, and the structural elements that are different from those in the sewing machine 1 according to the first embodiment and the second embodiment will hereinafter be explained. In the drawings that are hereinafter described, the same reference numerals are assigned to the structures that are the same as in the sewing machine 1 according to one of the first embodiment and the second embodiment.

Figure 22:
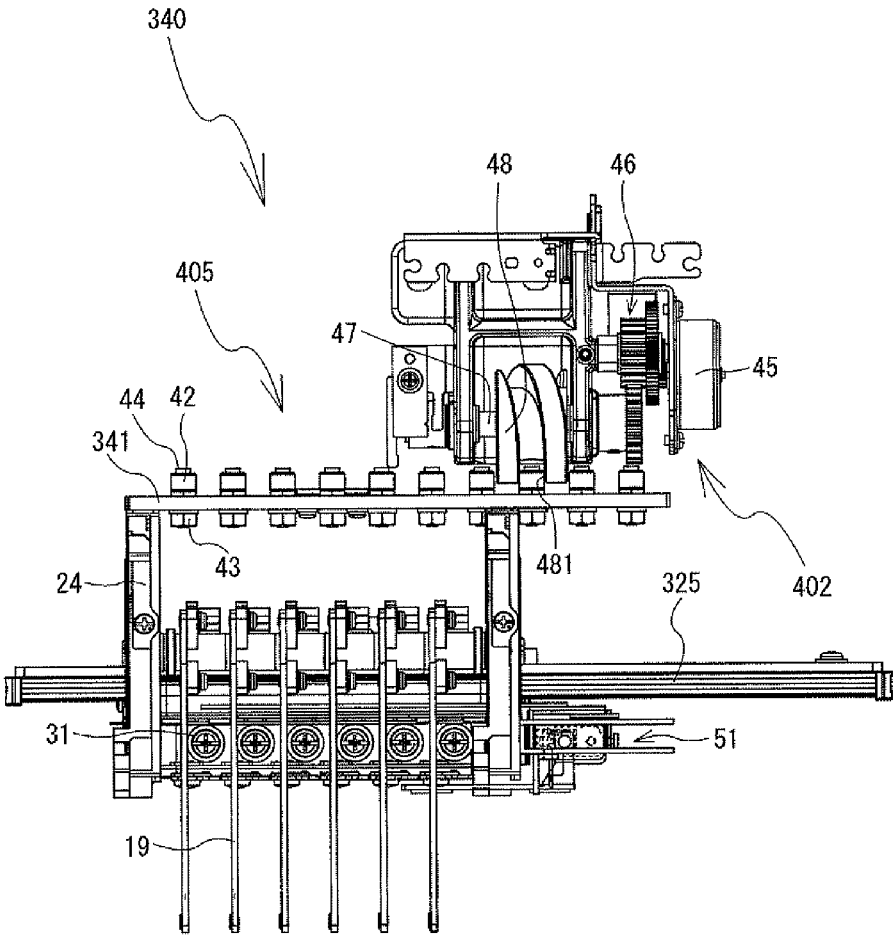
FIG. 22 is a plan view of a needle bar case moving mechanism according to a third embodiment in a case where an engaging roller that is third from the right is engaged with the positioning portion of the helical cam.

A needle bar case moving mechanism 340 according to the third embodiment will be explained with reference to FIG. 22. In FIG. 22, the lower side, the upper side, the left side, and the right side of the page respectively indicate the front side, the rear side, the left side, and the right side of the sewing machine 1.

As shown in FIG. 22, the needle bar case moving mechanism 340 according to the third embodiment includes an engaging roller portion 405 and the needle bar case drive portion 402. The engaging roller portion 405 includes a plate 341, the engaging rollers 42, the nuts 43, and the shoulder screws 44. The plate 341 extends farther to the right, by the distance X, than does the plate 41 in the sewing machine 1 according to the first embodiment. The engaging rollers 42, the nuts 43, and the shoulder screws 44 are the same as in the first embodiment. However, in the sewing machine 1 according to the third embodiment, ten each of the engaging rollers 42, the nuts 43, and the shoulder screws 44 are provided. The tenth engaging roller 42, which is a point of difference from the sewing machine 1 according to the first embodiment, is attached the farthest to the right. The distance between the tenth engaging roller 42 and the adjacent engaging roller 42 is the distance X. The needle bar case drive portion 402 is the same as in the first embodiment, so an explanation will be omitted.

A slide rail 325 according to the third embodiment extends farther to the left than does the slide rail 25 in the sewing machine 1 according to the first embodiment by the distance X. In a case where the engaging roller 42 that is disposed the farthest toward the right side is engaged with the positioning portion 481 of the helical cam 48, the frame 24 is at the left end of the slide rail 325.

An image sensor holding mechanism 351 (hereinafter simply called the holding mechanism 351) according to the third embodiment will be explained with reference to FIGS. 23 and 24. In the explanation that follows, in FIG. 23, the right side, the left side, the front side, and the rear side of the page respectively indicate the right side, the left side, the front side, and the rear side of the sewing machine 1. In FIG. 24, the lower left side, the upper right side, the upper left side, and the lower right side of the page respectively indicate the front side, the rear side, the left side, and the right side of the sewing machine 1.

Figure 23:
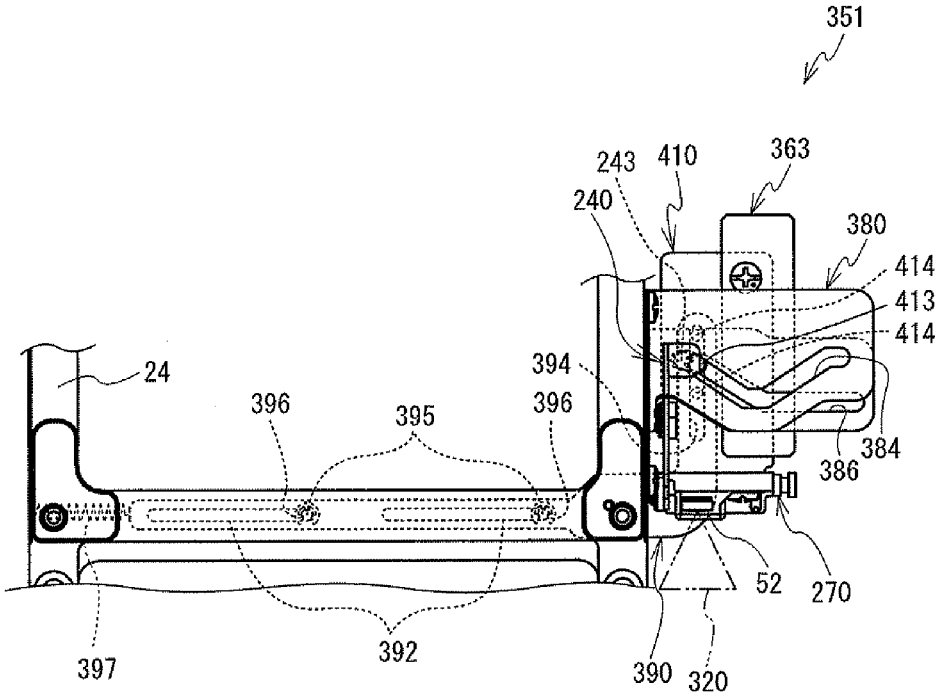
FIG. 23 is a front view of the image sensor holding mechanism when the image sensor is disposed in a normal position.
Figure 24:
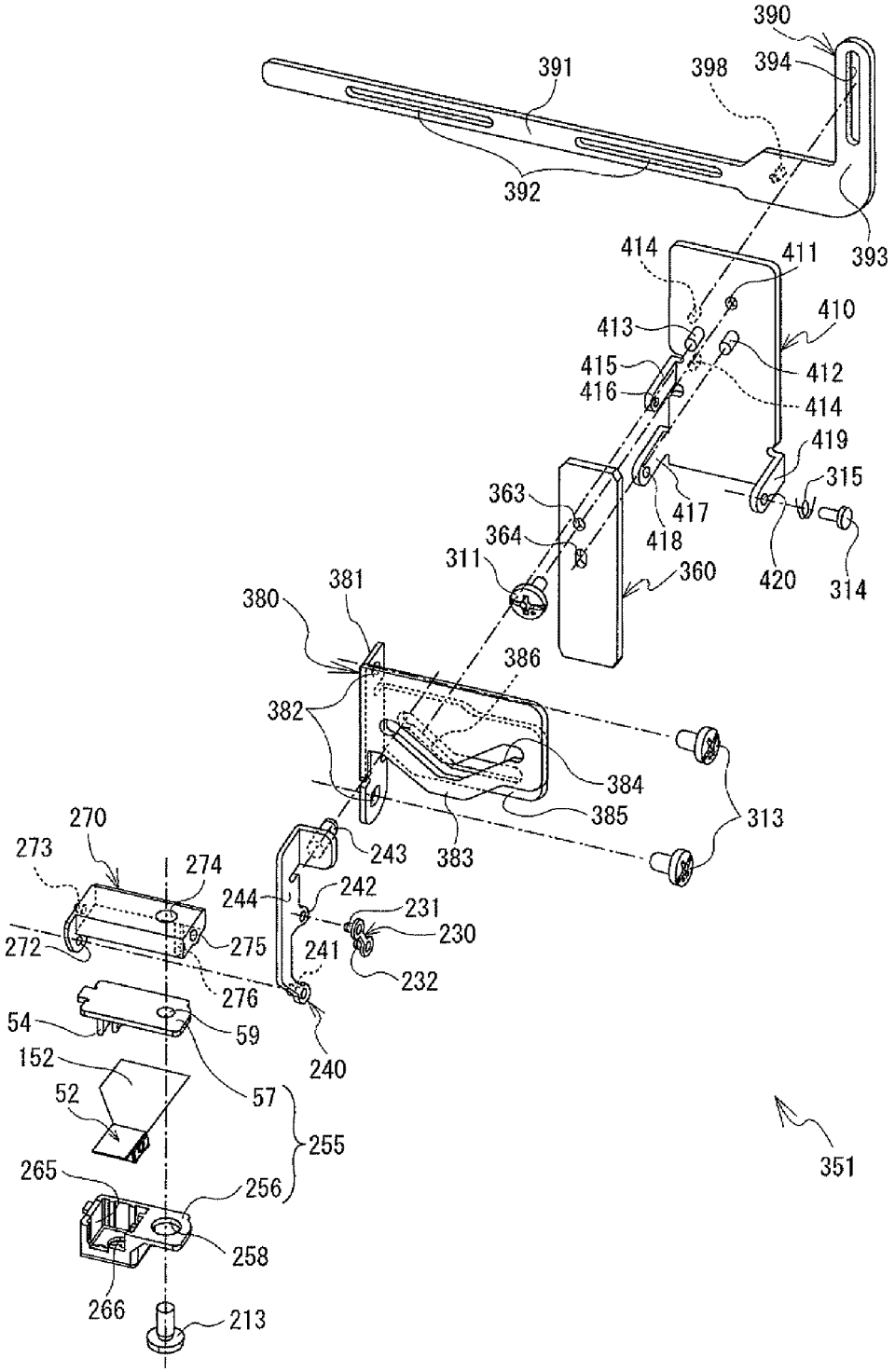
FIG. 24 is an oblique exploded view of the image sensor holding mechanism.

As shown in FIG. 23, the holding mechanism 351 is attached to the lower portion of the right side face of the frame 24. As shown in FIGS. 23 and 24, the holding mechanism 351 includes the image sensor 52, the sensor holder 255, the sensor link member 270, the actuating link member 240, the driven link member 230, a cam plate 380, a connecting plate 360, an attaching member 410, and a guide plate 390. The sensor link member 270, the actuating link member 240, the driven link member 230, and the attaching member 410 configure a four-bar parallel linkage. Hereinafter, the structural elements which the holding mechanism 351 includes will be explained in detail.

The image sensor 52 is the same as in the first embodiment. The sensor holder 255, the sensor link member 270, the actuating link member 240, and the driven link member 230 are the same as in the second embodiment.

The cam plate 380 may be formed by bending two ends of a rectangular plate in the same direction at right angles, and the cam plate 380 includes a face 381, a face 383, and a face 385. The face 381 has a rectangular shape when viewed from the right side. The face 381 is provided with two holes 382, one above the other. The cam plate 380 is secured to the lower portion of the right side face of the frame 24 by screws 313 that are inserted into the holes 382. The face 383 extends orthogonally toward the right from the front edge of the face 381. A guide hole 384 that is V-shaped in a front view, with the sloping sides of the V shape inclined in relation to the direction of movement of the needle bar case 21 (the horizontal direction) is provided in the face 383. The pin 243 of the actuating link member 240 is inserted into the guide hole 384. The face 385 extends orthogonally toward the right from the rear edge of the face 381. A guide hole 386, a portion of which is inclined in relation to the direction of movement of the needle bar case 21 (the horizontal direction), is provided in the face 385.

The connecting plate 360 has a rectangular plate shape in a front view and the connecting plate 360 electrically connects the image sensor 52 and the control portion 140 (refer to FIG. 8) of the sewing machine 1. The connecting plate 360 is provided with a connector that is electrically connected to the image sensor 52 and a connector that is electrically connected to the control portion 140 of the sewing machine 1, although these are not shown in the drawings. A screw hole 363 and a hole 364 are provided in the central portion of the connecting plate 360, one above the other.

The attaching member 410 is a member that has a plate shape in a front view. The attaching member 410 is provided with a function as a fixed link in the four-bar parallel linkage, which will be described later. A screw hole 411 and a pin 12 that projects toward the front are provided in the central portion of the attaching member 410, one above the other. The connecting plate 360 is secured to the front face of the attaching member 410 by a screw 311 that passes through the screw hole 363 of the connecting plate 360 and through the screw hole 411 of the attaching member 410. The pin 412 is inserted into the hole 364 of the connecting plate 360, restricting the rotation of the connecting plate 360 around the screw 311. A pin 413 that projects toward the front is provided to the left of the pin 412. The pin 413 is inserted into the guide hole 386 of the cam plate 380. A plate-shaped support portion 415 that projects toward the front is provided on the left edge of the attaching member 410. A hole 416 that is circular when viewed from the right side is provided at the front end side of the support portion 415. The pin 232 of the driven link member 230 is inserted into the hole 416. A plate-shaped support portion 419 that projects toward the front is provided on the lower right edge of the attaching member 410. A hole 420 that is circular when viewed from the right side is provided at the front end side of the support portion 419. A screw 314 is inserted into the hole 420 and into the screw hole 275 of the sensor link member 270. A plate-shaped support portion 417 that projects toward the front is provided on the lower left edge of the attaching member 410. A hole 418 that is circular when viewed from the right side is provided at the front end side of the support portion 417. The pin 273 of the sensor link member 270 is inserted into the hole 418. In the same manner as in the second embodiment, a torsion spring 315 is attached to the screw 314. The sensor link member 270 is urged by the torsion spring 315 toward the counterclockwise direction as seen from the right side. The sensor link member 270 is rotatably supported in the attaching member 410 by the screw 314 and the pin 273. Two pins 414 are provided in the left portion of the rear face of the attaching member 410, one above the other.

The guide plate 390 has a configuration that is basically the same as that of the guide plate 90 according to the first embodiment. The guide plate 390 is L-shaped in a front view and includes a slide portion 391 and a support portion 393. Two guide holes 392 are provided in the slide portion 391 in the left-right direction. The guide holes 392 are elongated holes that are long in the left-right direction. As shown in FIG. 23, positioning pins 395 that are press fitted into the frame 24 are inserted into the guide holes 392. The rear ends of the positioning pins 395 that are inserted into the guide holes 392 are secured by retaining rings 396. One end of a spring 397 is attached to the left end of the slide portion 391. The other end of the spring 397 is secured to the frame 24. The guide plate 390 is urged by the spring 397 toward the left side of the sewing machine 1. A guide hole 394 is located in the support portion 393, with its long dimension running in the up-down direction. The pins 414 of the attaching member 410 are inserted into the guide hole 394. The ends of the pins 414 are secured by retaining rings (not shown in the drawings). A projecting portion 398 that projects toward the arm 4 is provided in the lower portion of the rear face of the support portion 393. In a case where the needle bar case 21 has been moved to a position where the third engaging roller 42 from the right is engaged with the positioning portion 481 of the helical cam 48, the projecting portion 398 is in contact with the projecting portion 49 (refer to FIG. 25) that is provided in the interior of the arm 4.

Figure 26:
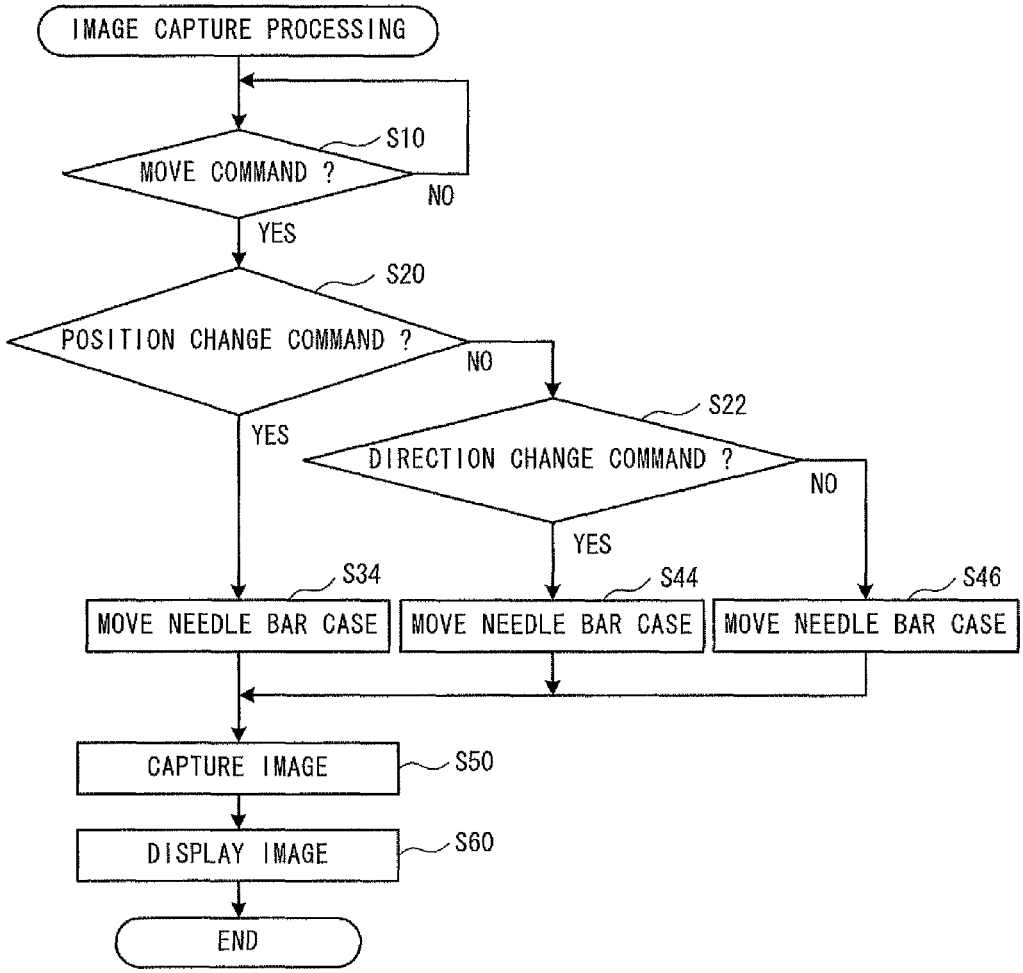
FIG. 26 is a flowchart of image capture processing according to the third embodiment.

Image capture processing according to the third embodiment will be explained with reference to FIG. 26. In the image capture processing, the sewing machine 1 according to the third embodiment displays on the LCD 7 an image that has been captured by the image sensor 52. The image capture processing that is shown in FIG. 26 is started in a case where the start command has been input, in the same manner as the image capture processing according to the first embodiment. The image capture processing that is shown in FIG. 26 is performed by the CPU 141 that is shown in FIG. 8, in accordance with the image capture program that is stored in the ROM 142. Note that in FIG. 26, the steps where the same processing is performed that is performed in the image capture processing according to the first embodiment in FIG. 9 or in the image capture processing according to the second embodiment in FIG. 19 are assigned the same step numbers. Explanations of the steps that are the same as in the image capture processing according to the first or the second embodiments will be omitted or simplified.

First, an overview of the image capture processing according to the third embodiment will be explained. In a case where the image capture condition is the first condition, the sewing machine 1 moves the needle bar case 21 to the position (hereinafter simply called the first corresponding position) where the third engaging roller 42 from the right engages the positioning portion 481 of the helical cam 48, as shown in FIG. 22. In a case where the image capture condition is the second condition, the sewing machine 1 moves the needle bar case 21 to the position (hereinafter simply called the second corresponding position) where the second engaging roller 42 from the right engages the positioning portion 481 of the helical cam 48. In a case where the image capture condition is the third condition, the sewing machine 1 moves the needle bar case 21 to the position (hereinafter simply called the third corresponding position) where the engaging roller 42 that is the farthest to the right engages the positioning portion 481 of the helical cam 48. The image capture condition is selected by the user and is input by the panel operation as a part of the move command.

The image capture processing in FIG. 26 will be explained in more detail. As shown in FIG. 26, in the image capture processing according to the third embodiment, a determination is made as to whether the move command that has been acquired at Step S10 (YES at Step S10) is a position change command (Step S20). In a case where the image capture condition that is included in the move command that has been acquired at Step S10 is the second condition, a determination is made that the move command that has been acquired at Step S10 is a position change command (YES at Step S20). In a case where the move command that has been acquired at Step S10 is not a position change command (NO at Step S20), a determination is made as to whether the move command that has been acquired at Step S10 is a direction change command (Step S22). In a case where the image capture condition that is included in the move command that has been acquired at Step S10 is the third condition, a determination is made that the move command that has been acquired at Step S10 is a direction change command (YES at Step S22).

Figure 25:
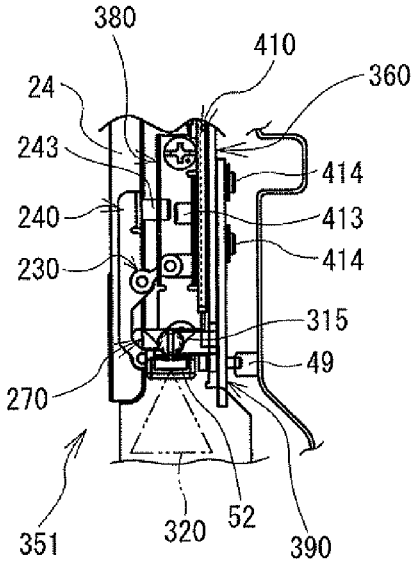
FIG. 25 is a right side view of the image sensor holding mechanism when the image sensor is disposed in the normal position.

In a case where the move command that has been acquired at Step S10 is not a direction change command (NO at Step S22), the needle bar case 21 is moved to the first corresponding position (Step S46). More specifically, a control signal is output to the drive circuit 123, and the needle bar case motor 45 is driven such that the needle bar case 21 moves to the first corresponding position (a third position). In a case where the needle bar case 21 is at the first corresponding position, the various members of the holding mechanism 351 are in the positions that are hereinafter described. As shown in FIG. 23, the pin 243 of the actuating link member 240 is at the left end of the guide hole 384 in the cam plate 380. The pin 413 of the attaching member 410 is at the left end of the guide hole 386 in the cam plate 380. Of the two pins 414 of the attaching member 410, the upper pin 414 is at the upper end of the guide hole 394 in the guide plate 390. As shown in FIG. 25, an image capture direction 320 of the image sensor 52 is the facing downward direction, and the position of the image sensor 52 in the vertical direction is the normal position.

Figure 27:
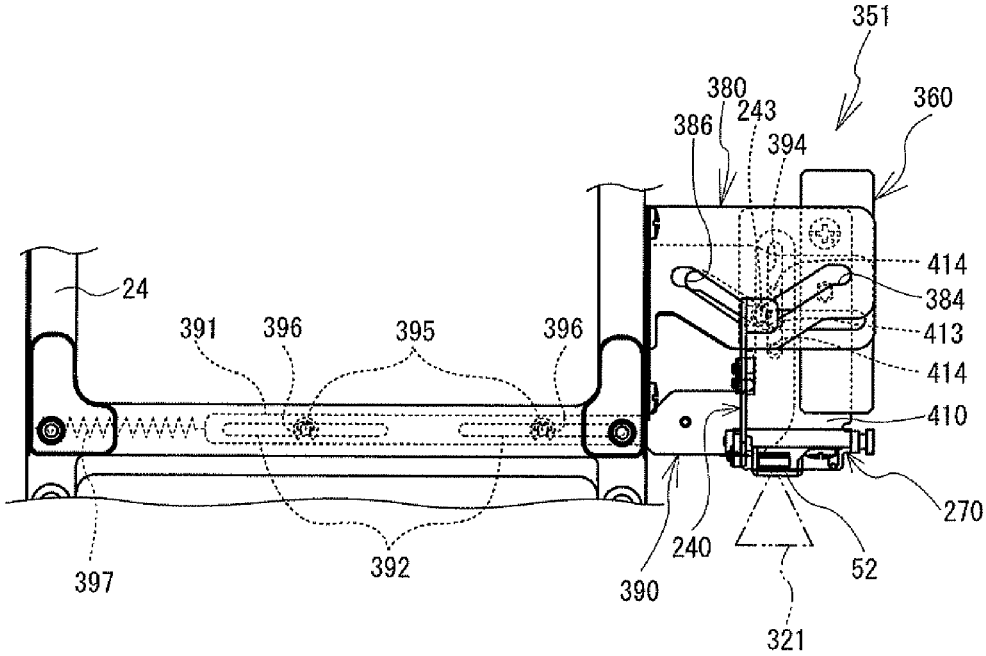
FIG. 27 is a front view of the image sensor holding mechanism when it is disposed in a zoom position.
Figure 28:
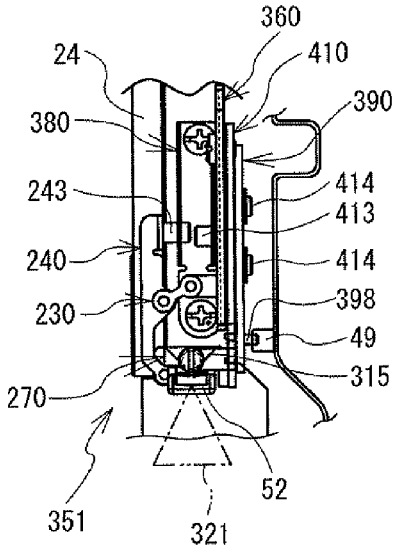
FIG. 28 is a right side view of the image sensor holding mechanism when it is disposed in the zoom position.

In a case where the move command that has been acquired at Step S10 is a position change command (YES at Step S20), the needle bar case 21 is moved to the second corresponding position (Step S34). More specifically, a control signal is output to the drive circuit 123 (refer to FIG. 8), and the needle bar case motor 45 is driven such that the needle bar case 21 is moved to the second corresponding position. In a case where the needle bar case 21 is at the second corresponding position (a position between a second position and the third position), the various members of the holding mechanism 351 are in the positions that are hereinafter described. As shown in FIG. 27, the pin 243 of the actuating link member 240 is in the center of the left-right direction of the guide hole 384 in the cam plate 380. The pin 413 of the attaching member 410 is in the center of the left-right direction of the guide hole 386 in the cam plate 380. Of the two pins 414 of the attaching member 410, the lower pin 414 is at the lower end of the guide hole 394 in the guide plate 390. As shown in FIGS. 27 and 28, an image capture direction 321 of the image sensor 52 is the facing downward direction, and the position of the image sensor 52 in the vertical direction is the zoom position.

The operation of the holding mechanism 351 at Step S34 will be explained. In the same manner as in the sewing machine 1 according to the first embodiment, in a case where the needle bar case 21 has been moved to the position in FIG. 22 (the third position), the projecting portion 398 of the guide plate 390 is in contact with the projecting portion 49 that is provided in the interior of the arm 4 (refer to FIG. 25). When the needle bar case 21 is moved farther to the left than the position in FIG. 22, the movement of the guide plate 390 in the direction in which the needle bar case 21 is moving is restricted by the projecting portion 49, such that the guide plate 390 slides to the right (in the horizontal direction) in relation to the needle bar case 21.

In contrast to this, the cam plate 380, because the cam plate 380 is secured to the right side face of the frame 24, moves together with the needle bar case 21, even when the positional relationship between the needle bar case 21 and the guide plate 390 is changed. When the guide plate 390 slides in relation to the needle bar case 21, the pin 243 of the actuating link member 240 is guided in the guide hole 384 of the cam plate 380 and is moved downward in relation to the needle bar case 21, even as the horizontal position of the pin 243 in relation to the body 20 remains fixed. The pin 413 of the attaching member 410 is also guided in the guide hole 386 of the cam plate 380 and is moved downward, even as the horizontal position of the pin 413 in relation to the body 2 remains fixed. In a case where the needle bar case 21 is at the second corresponding position, the position of the image sensor 52 in the vertical direction is lower than it is in a case where the needle bar case 21 is at the first corresponding position. The inclination angles of the portions of the guide hole 384 and the guide hole 386 that correspond to the movement of the needle bar case 21 from the first corresponding position to the second corresponding position are the same. Therefore, the position of the pin 243 of the actuating link member 240 in relation to the attaching member 410 remains fixed, even in a case where the needle bar case 21 has moved from the first corresponding position to the second corresponding position. The operation of the holding mechanism 351 in a case where the needle bar case 21 is moved from the second corresponding position to the first corresponding position is the opposite of the operation when the needle bar case 21 is moved from the first corresponding position to the second corresponding position.

Figure 29:
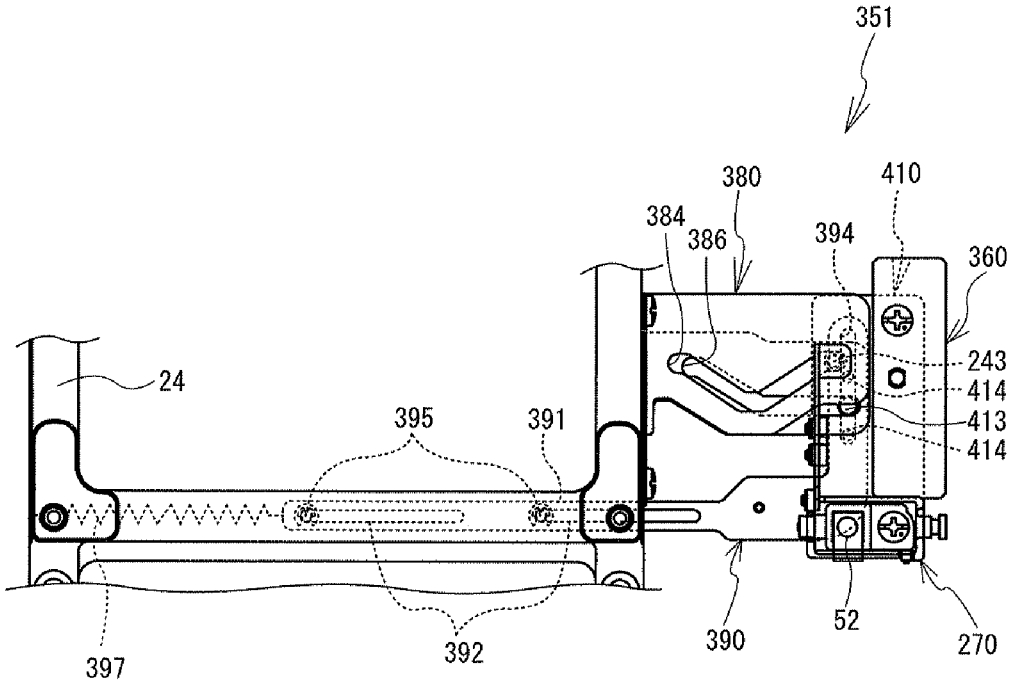
FIG. 29 is a front view of the image sensor holding mechanism when the image capture direction has been set to facing forward.
Figure 30:
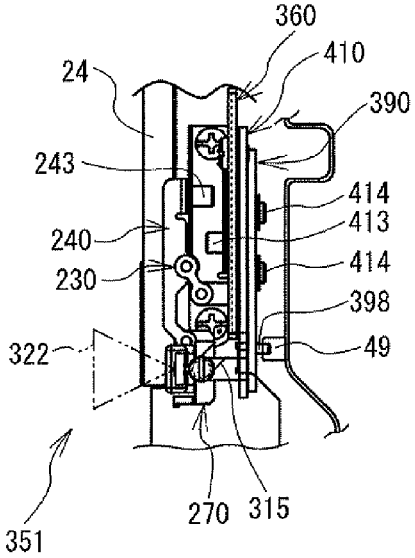
FIG. 30 is a right side view of the image sensor holding mechanism when the image capture direction has been set to facing forward.

In a case where the move command that has been acquired at Step S10 is a direction change command (NO at Step S20, YES at Step S22), the needle bar case 21 is moved to the third corresponding position (Step S44). More specifically, a control signal is output to the drive circuit 123 (refer to FIG. 8), and the needle bar case motor 45 is driven such that the needle bar case 21 is moved to the third corresponding position (the second position). In a case where the needle bar case 21 is at the third corresponding position, the various members of the holding mechanism 351 are in the positions that are hereinafter described. As shown in FIG. 29, the pin 243 of the actuating link member 240 is at the right end of the guide hole 384 in the cam plate 380. The pin 413 of the attaching member 410 is at the right end of the guide hole 386 in the cam plate 380. Of the two pins 414 of the attaching member 410, the lower pin 414 is at the lower end of the guide hole 394 in the guide plate 390. As shown in FIG. 30, an image capture direction 322 of the image sensor 52 is the facing forward direction, and the position of the image sensor 52 in the vertical direction is the zoom position.

The operation of the holding mechanism 351 at Step S44 will be explained. When the needle bar case 21 is moved from the second corresponding position to the third corresponding position, the guide plate 390 slides farther in relation to the needle bar case 21. The pin 243 of the actuating link member 240 is guided in the guide hole 384 of the cam plate 380 and is moved upward in relation to the needle bar case 21, even as the horizontal position of the pin 243 in relation to the body 20 remains fixed. The pin 413 of the attaching member 410 is also guided in the guide hole 386 of the cam plate 380 and is moved to the right in relation to needle bar case 21, even as the position of the pin 413 in relation to the body 20 in the horizontal direction and the vertical direction remains fixed. The inclination angles of the portions of the guide hole 384 and the guide hole 386 that correspond to the movement of the needle bar case 21 from the second corresponding position to the third corresponding position are different. Therefore, the position of the pin 243 of the actuating link member 240 in relation to the attaching member 410 changes in a case where the needle bar case 21 has moved from the second corresponding position to the third corresponding position. More specifically, in a case where the needle bar case 21 is at the third corresponding position, the position of the pin 243 in relation to the attaching member 410 is higher than it is in a case where the needle bar case 21 is at the second corresponding position. In the same manner as in the case of the second embodiment, the image sensor 52 (the sensor link member 270) is rotated ninety degrees clockwise by the changing of the position of the pin 243 in relation to the attaching member 410.

Following whichever of Step S34, Step S44, and Step S46 is performed, an image is captured by the image sensor 52 at a specified timing (Step S50), and the image is displayed on the LCD 7 based on the generated image data (Step S60).

In the sewing machine 1 according to the third embodiment that has been explained above, it is possible to move the image sensor 52 in relation to the needle bar case 21 in accordance with the move command that is acquired at Step S10 in FIG. 26 (Step S34, Step S44, Step S46). By inputting the move command, the user can change one of the image capture direction and the image capture position of the image sensor 52 and can acquire images with different fields of view before and after the moving, particularly images for which one of the image capture directions and the image capture positions in the vertical direction are different. The sewing machine 1 can change one of the image capture direction and the image capture position of the image sensor 52 by moving the image sensor 52 in relation to the needle bar case 21 in conjunction with the moving of the needle bar case 21. The sewing machine 1 does not require a dedicated drive source for changing the image capture condition for the image sensor 52. In other words, the sewing machine 1 can provide a configuration for a moving device for changing the image capture direction of the image sensor 52 and a moving device for changing the position of the image sensor 52 in the vertical direction that is simpler than the configuration in a case where the moving devices are provided separately from the needle bar case moving mechanism 40. The sewing machine 1 includes the sensor holder 255, the sensor link member 270, the attaching member 410, the actuating link member 240, the driven link member 230, the cam plate 380, and the guide plate 390 as a coupling member that is a member for moving the image sensor 52. The use of the coupling member that has a comparatively simple configuration makes it possible for the sewing machine 1 to change one of the image capture direction and the image capture position of the image sensor 52 in accordance with the move command.

Figure 31:
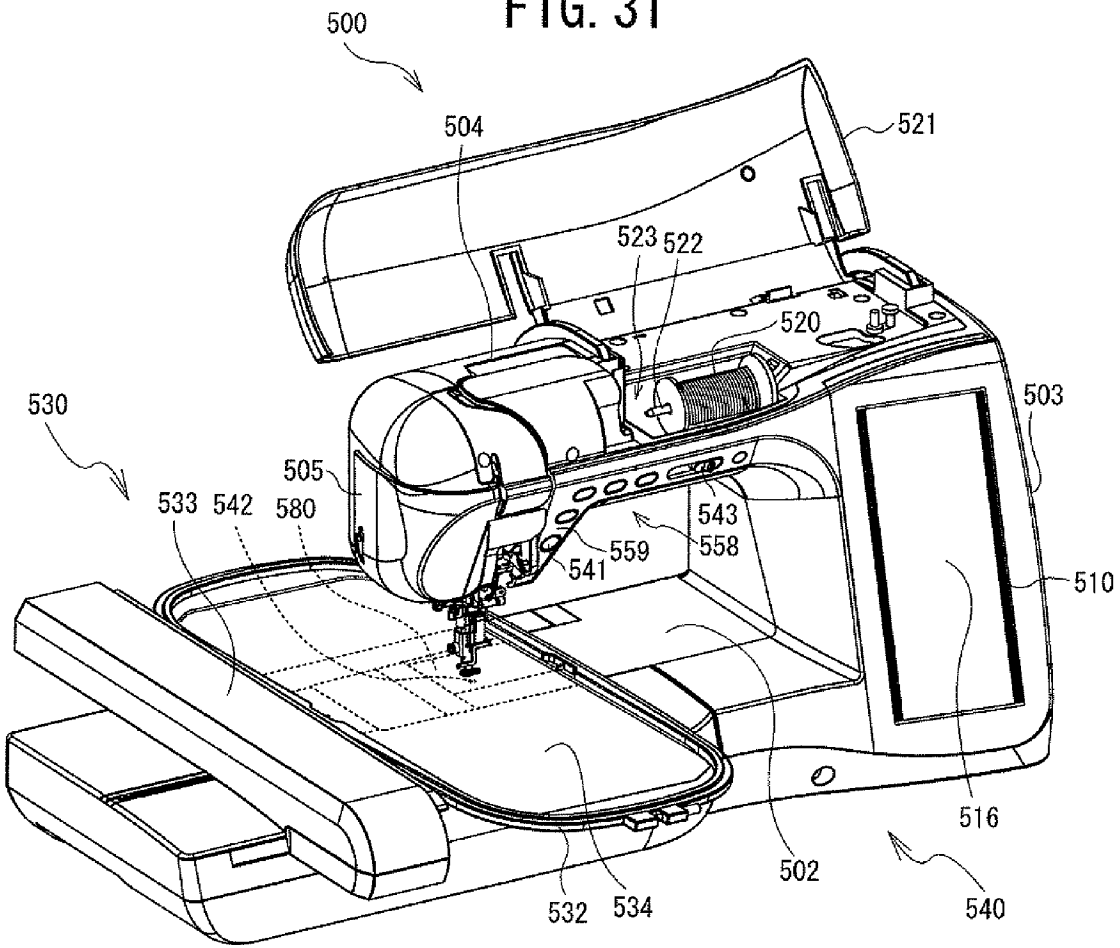
FIG. 31 is an oblique view of a sewing machine.

A sewing machine 500 according to a forth embodiment will be explained. A physical configuration and an electrical configuration of the sewing machine 500 according to the forth embodiment will be explained with reference to FIGS. 31 to 34. In FIG. 31, the upper right side, the lower left side, the lower right side, and the upper left side of the page respectively indicate the right side, the left side, the front side and the rear side of the sewing machine 500. As shown in FIG. 31, a body 540 of the sewing machine 500 is provided with a bed 502, a pillar 503, and an arm 504. The bed 502 extends in the right-left direction. The pillar 503 extends upward from the right end of the bed 502. The arm 504 extends to the left from the upper end of the pillar 503. The head 505 is provided in the left end portion of the arm 504. A LCD 510 that is provided with a touch panel 516 on its front face is provided on the front face of the pillar 503. Input keys and the like for a sewing pattern and sewing conditions are displayed on the LCD 510. By performing the panel operations, the user can select various types of conditions that relate to the sewing pattern and the sewing.

A feed dog front-rear drive mechanism (not shown in the drawings), a feed dog up-down drive mechanism (not shown in the drawings), a feed adjustment pulse motor 578 (refer to FIG. 33), and a shuttle (not shown in the drawings) are housed in the interior of the bed 502. The feed dog front-rear drive mechanism and the feed dog up-down drive mechanism drive a feed dog (not shown in the drawings). The feed adjustment pulse motor 578 adjusts the amount that a work cloth (not shown in the drawings) is fed by the feed dog. The shuttle contains a bobbin (not shown in the drawings), around which a lower thread (not shown in the drawings) is wound. An embroidery device 530 may be mounted on the left end of the bed 502. When an embroidery pattern is being sewn, an embroidery frame 532, by which a work cloth 534 is held, is set on a carriage (not shown in the drawings) inside a carriage cover 533. The sewing machine 500 sews the embroidery pattern while the embroidery frame 532 is moved toward the front, the rear, the left, and the right by an X axis motor 581 (refer to FIG. 33) and a Y axis motor 582 (refer to FIG. 33) of the embroidery device 530. In a case where the embroidery frame 532 is not used, an auxiliary table (not shown in the drawings) may be mounted on the left end of the bed 502. When the embroidery device 530 is mounted on the left end of the bed 502, the embroidery device 530 is in a state of being electrically connected to the sewing machine 500. A plate-shaped needle plate 580 is provided on the top face of the bed 502. A needle hole 542 through which a needle 507 passes is provided in the needle plate 580

Figure 32:
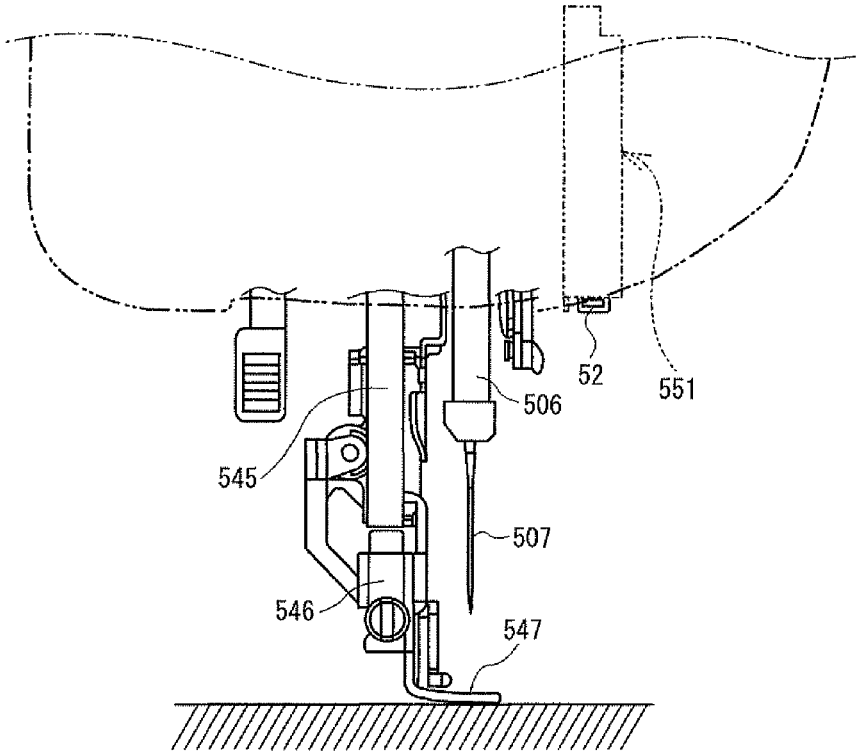
FIG. 32 is a view of an area around a needle as seen from the left side of the sewing machine.

A sewing machine motor 579 (refer to FIG. 33), a main shaft (not shown in the drawings), a needle bar 506 (refer to FIG. 32), a needle bar up-down drive mechanism (not shown in the drawings), and a needle bar swinging mechanism (not shown in the drawings) are contained in the interior of the pillar 503 and the arm 504. As shown in FIG. 32, the needle 507 may be attached to the lower end of the needle bar 506. The needle bar up-down drive mechanism, using the sewing machine motor 579 as a drive source, moves the needle bar 506 up and down. The needle bar swinging mechanism, using a needle bar swinging pulse motor 577 (refer to FIG. 33) as a drive source, swings the needle bar 506 to the left and to the right. As shown in FIG. 32, a presser bar 545 that extends in the up-down direction is provided to the rear of the needle bar 506. A presser holder 546 is secured to the bottom end of the presser bar 545. A presser foot 547 that presses down on the work cloth (not shown in the drawings) is mounted in the presser holder 546.

As shown in FIG. 31, a top cover 521 to be opened and closed is attached to the top of the arm 504. The top cover 521 is provided in the longitudinal direction of the arm 504, and the top cover 521 is axially supported at the rear upper edge of the arm 504 such that the top cover 521 may be opened and closed around the right-left directional axis. A thread spool housing 523 is provided close to the middle of the top of the arm 504 under the top cover 521. The thread spool housing 523 is a recessed portion for housing a thread spool 520. A spool pin 522, which projects toward the head 505, is disposed on an inner face of the thread spool housing 523 on the pillar 503 side. The thread spool 520 may be attached to the thread spool housing 523 when the spool pin 522 is inserted through an insertion hole (not shown in the drawings) that is formed in the thread spool 520. An upper thread (not shown in the drawings), which extends from the thread spool 520, may be supplied to a needle 507 (refer to FIG. 32) through a plurality of thread guide portions that are provided in the head 505. The sewing machine 500 includes, as the thread guide portions, a tensioner (not shown in the drawings), a thread take-up spring (not shown in the drawings), and a thread take-up lever (not shown in the drawings), for example. The tensioner and the thread take-up spring adjust thread tension. The thread take-up lever is driven reciprocally up and down and pulls the upper thread up.

A pulley (not shown in the drawings) is provided on the right side face of the sewing machine 500. The pulley allows the main shaft (not shown in the drawings) to be rotated manually, causing the needle bar 506 to move up and down. A front cover 559 is provided on the front face of the head 505 and the arm 504. An operation switch group 558 that includes a sewing start-and-stop switch 541 and a speed controller 543 is provided on the front cover 559. The sewing start-and-stop switch 541 is a switch that generates commands to start and stop sewing. If the sewing start-and-stop switch 541 is pressed while the sewing machine 500 is stopped, the operation of the sewing machine 500 is started, and if the sewing start-and-stop switch 541 is pressed while the sewing machine 500 is in operation, the operation of the sewing machine 500 is stopped. The speed controller 543 adjusts the rotation speed of the main shaft. As shown in FIG. 32. The image sensor 52 is installed inside the front cover 559. The image sensor 52 is the same sort of CMOS image sensor as it is in the first embodiment. The image sensor 52 is supported by an image sensor drive mechanism 551 (hereinafter simply called the drive mechanism 551).

Figure 34:
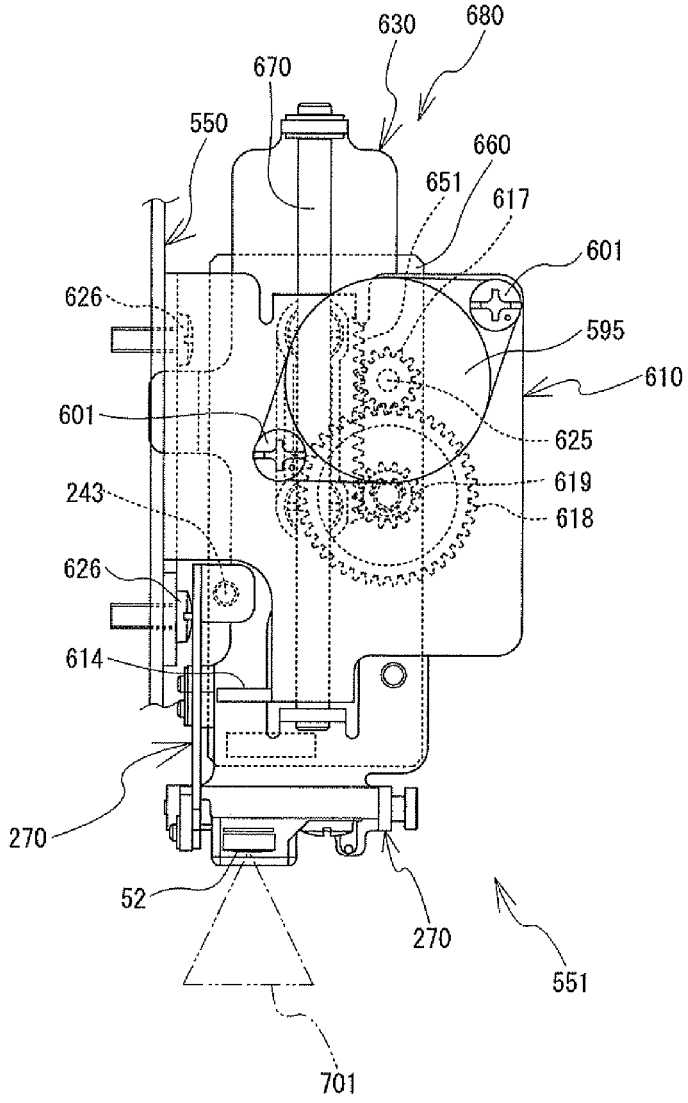
FIG. 34 is a front view of an image sensor drive mechanism when the image sensor is disposed in a normal position.
Figure 35:
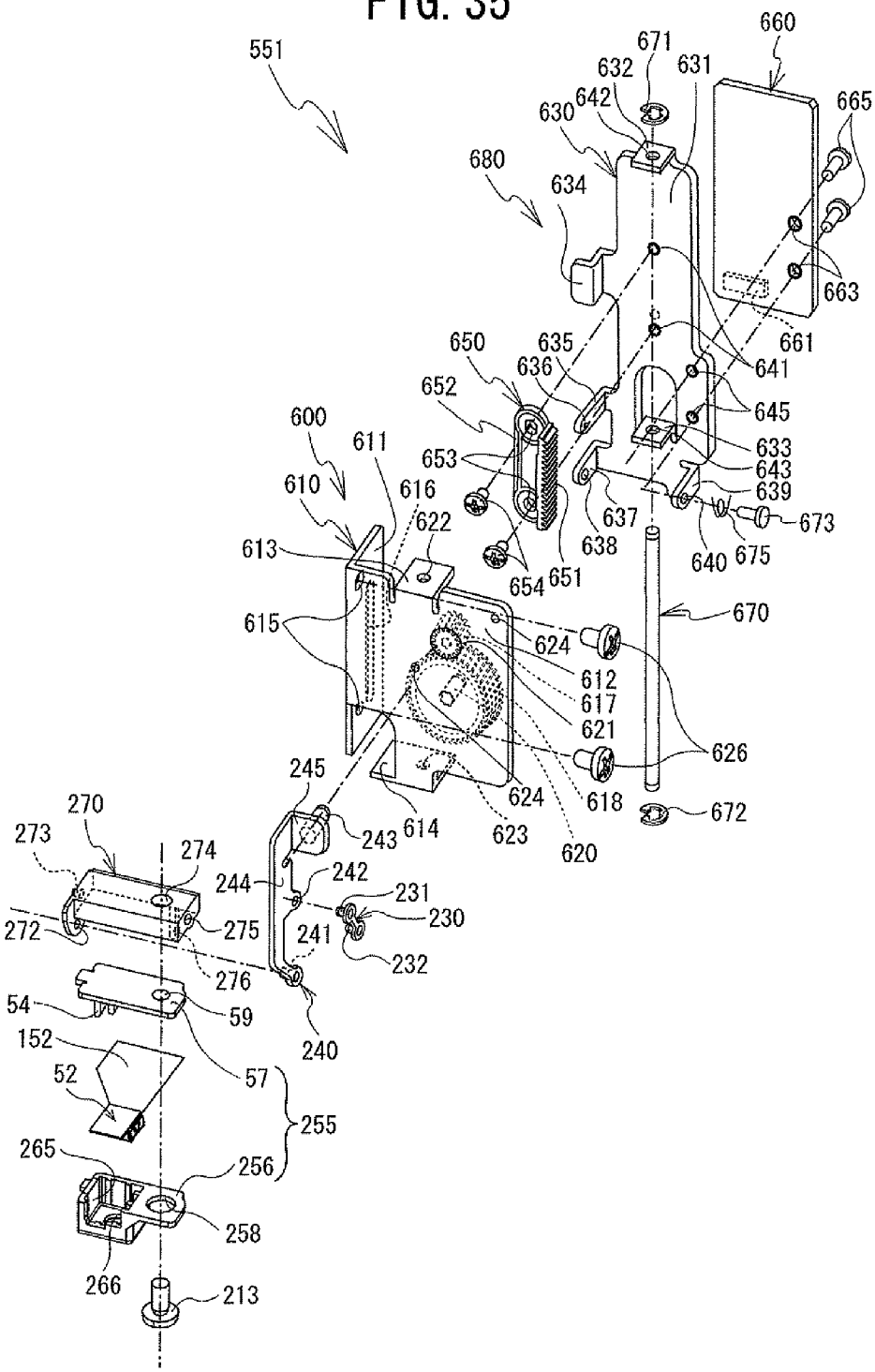
FIG. 35 is an oblique exploded view of the image sensor drive mechanism.
Figure 36:
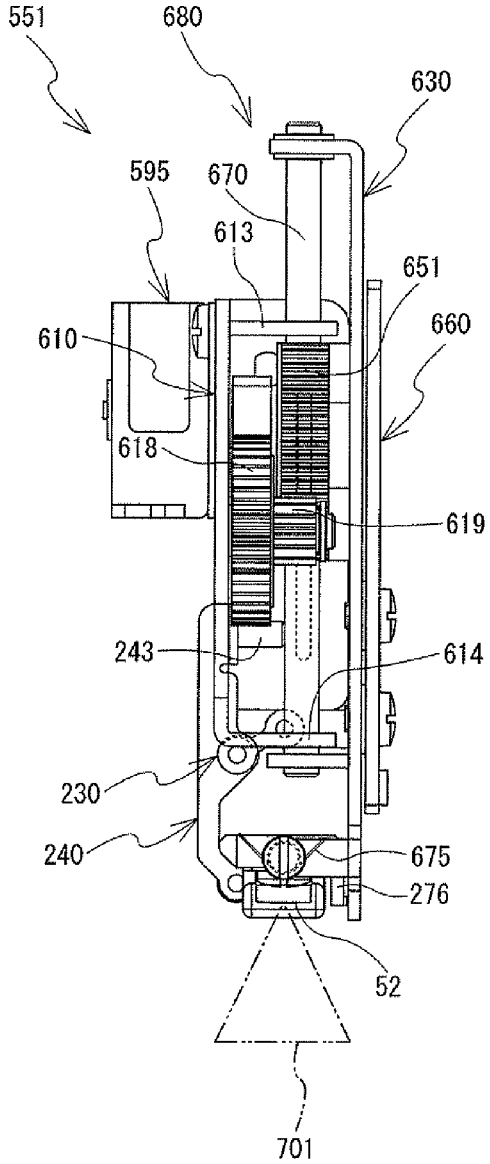
FIG. 36 is a right side view of the image sensor drive mechanism when the image sensor is disposed in the normal position.

The image sensor 52 and the drive mechanism 551 will be explained with reference to FIG. 32 and FIGS. 34 to 36. In FIG. 35, the lower left side, the upper right side, the upper left side, and the lower right side of the page respectively indicate the front side, the rear side, the left side, and the right side of the sewing machine 1. As shown in FIG. 34, the drive mechanism 551 is attached to an attaching portion 550 that is attached to a frame (not shown in the drawings) of the sewing machine 500. As shown in FIGS. 34 to 36, the drive mechanism 551 includes the image sensor 52, the sensor holder 255, the sensor link member 270, the actuating link member 240, the driven link member 230, a drive unit 600, a sensor unit 680, and a connecting plate 660. The sensor link member 270, the actuating link member 240, the driven link member 230, and the sensor unit 680 configure a four-bar parallel linkage. Hereinafter, the structural elements with which the drive mechanism 551 is provided will be explained in detail.

The image sensor 52 is the same as in the first embodiment, so an explanation will be omitted. As shown in FIG. 32, the image sensor 52 is provided in a position that is opposite the needle plate 580 (refer to FIG. 31), and it can capture an image of the needle hole 542. The sensor holder 255, the sensor link member 270, the actuating link member 240, and the driven link member 230 are the same as in the second embodiment, so explanations will be omitted.

The drive unit 600, using a pulse motor 595 as a drive source, moves the sensor unit 680 up and down. The drive unit 600 includes the pulse motor 595, a base plate 610, and gears 617 to 619. The pulse motor 595 is not shown in FIG. 35. The pulse motor 595 is the drive source for the drive mechanism 551. The pulse motor 595 moves the sensor unit 680, which will be described later, in the vertical direction. The pulse motor 595 and the gears 617 to 619 are attached to the base plate 610. The base plate 610 includes an attaching portion 611, a support portion 612, a shaft pass-through portion 613, and a shaft pass-through portion 614. The attaching portion 611 has a plate-like shape that is rectangular as seen from the right side. The attaching portion 611 is provided with two holes 615, one above the other. Screws 626 are inserted into the holes 615. The drive unit 600 is secured to the attaching portion 550, which is attached to the frame (not shown in the drawings) of the sewing machine 500, by the screws 626 that are inserted into the holes 615. The attaching portion 611 is provided with a slit 616 that extends in the up-down direction.

The support portion 612 extends orthogonally toward the right from the front edge of the attaching portion 611 and has a rectangular plate-like shape in a front view, with a cutout in the lower left portion. The support portion 612 supports the gears 617 to 619 and the pulse motor 595. A gear shaft 620 that projects toward the rear is provided in the central portion of the rear face of the support portion 612. The gear 618 and the gear 619 (refer to FIG. 34) are attached to the gear shaft 620. The gear 619 rotates as a single unit with the gear 618. The gear 618 is provided in front of the gear 619. Two screw holes 624 are provided in the upper right portion and the central portion of the support portion 612. The pulse motor 595 is secured to the support portion 612 by screws 601 (refer to FIG. 34) that are inserted into the screw holes 624. A hole 621 is provided in a position that is above the gear shaft 620 of the support portion 612. A rotating shaft 625 (refer to FIG. 34) of the pulse motor 595 is inserted into the hole 621. The gear 617 is attached to the rotating shaft 625. The gear 617 meshes with the gear 618. The gear 617 rotates when the pulse motor 595 operates. When the gear 617 rotates, the gear 618, which meshes with the gear 617, also rotates. When the gear 618 rotates, the gear 619 also rotates.

The shaft pass-through portion 613 is rectangular in a plan view and extends orthogonally toward the rear from the central portion of the upper edge of the support portion 612. A hole 622 that is circular in a plan view is provided in the shaft pass-through portion 613. The shaft pass-through portion 614 is rectangular in a plan view and extends orthogonally toward the rear from the central portion of the lower edge of the support portion 612. A hole 623 that is circular in a plan view is provided in the shaft pass-through portion 614.

The sensor unit 680 rotatably supports the sensor link member 270. The sensor unit 680 supports the connecting plate 660. The sensor unit 680 includes a base plate 630, a rack member 650, and a shaft 670. The base plate 630 includes a support portion 631, a shaft pass-through portion 632, a shaft pass-through portion 633, a restricting portion 634, a support portion 635, a support portion 637, and a support portion 639. The support portion 631 has a rectangular shape in a front view. The support portion 631 supports the rack member 650 and the connecting plate 660. Two screw holes 641 are provided, one above the other in a central portion in the left-right direction of the support portion 631. Two screw holes 645 are provided in the lower right portion of the support portion 631, one above the other.

The shaft pass-through portion 632 is rectangular in a plan view and extends orthogonally toward the front from the central portion of the upper edge of the support portion 631.

A hole 642 that is circular in a plan view is provided in the shaft pass-through portion 632. The shaft pass-through portion 633 is rectangular in a plan view and extends orthogonally toward the front from the lower central portion of the support portion 631. A hole 643 that is circular in a plan view is provided in the shaft pass-through portion 633. The restricting portion 634 is L-shaped in a plan view. The restricting portion 634 extends toward the front from the left edge of the support portion 631. In a case where the drive unit 600 is assembled together with the sensor unit 680, the restricting portion 634 is inserted into the slit 616 in the drive unit 600. The inserting of the restricting portion 634 into the slit 616 prevents the sensor unit 680 from rotating in relation to the drive unit 600.

The support portion 635 projects toward the front from the lower left portion of the support portion 631. A hole 636 that is circular as seen from the right side is provided in the front end portion of the support portion 635. The pin 232 of the driven link member 230 is inserted into the hole 636. The plate-shaped support portion 639 is provided at the lower right edge of the support portion 631 and projects toward the front. A hole 640 that is circular as seen from the right side is provided at the front end side of the support portion 639. A screw 673 is inserted into the hole 640 and into the screw hole 275 of the sensor link member 270. The plate-shaped support portion 637 is provided at the lower left edge of the support portion 631 and projects toward the front. A hole 638 that is circular as seen from the right side is provided at the front end side of the support portion 637. The pin 273 of the sensor link member 270 is inserted into the hole 638. The sensor link member 270 is rotatably supported by the pin 273 and the screw 673 that is inserted into the base plate 630. In the same manner as in the second and the third embodiments, a torsion spring 675 is attached to the screw 673. The sensor link member 270 is urged by the torsion spring 675 toward the counterclockwise direction as seen from the right side.

The rack member 650 includes a base portion 652 and a toothed portion 651. The base portion 652 extends lengthwise in the up-down direction. The base portion 652 has two screw holes 653, one above the other. Screws 654 are inserted into the screw holes 653, and the rack member 650 is secured to the front face of the base plate 630 by the screws 654. The toothed portion 651 is attached to the right side face of the base portion 652. The toothed portion 651 meshes with the gear 619 of the drive unit 600.

The shaft 670 is a rod that extends in the up-down direction, and the shaft 670 is inserted into the hole 623 and the hole 622 of the drive unit 600 and into the hole 642 and the hole 643 of the sensor unit 680. The shaft 670 defines the position of the sensor unit 680 in relation to the drive unit 600 in both the left-right direction and the up-down direction. The top end and the bottom end of the shaft 670 are respectively secured by a retaining ring 671 and a retaining ring 672.

The connecting plate 660 is a plate that is rectangular in a front view, and the connecting plate 660 electrically connects the image sensor 52 and a control portion 560 (refer to FIG. 33) of the sewing machine 500. The connecting plate 660 is provided with a connector 661 that is electrically connected to the image sensor 52 and with a connector (not shown in the drawings) that is electrically connected to the control portion 560 of the sewing machine 500. Two screw holes 663 are provided in the lower right portion of the connecting plate 660, one above the other. The connecting plate 660 is secured to the sensor unit 680 by screws 665 that are inserted into the screw holes 663 and into the screw holes 645 in the sensor unit 680.

Figure 33:
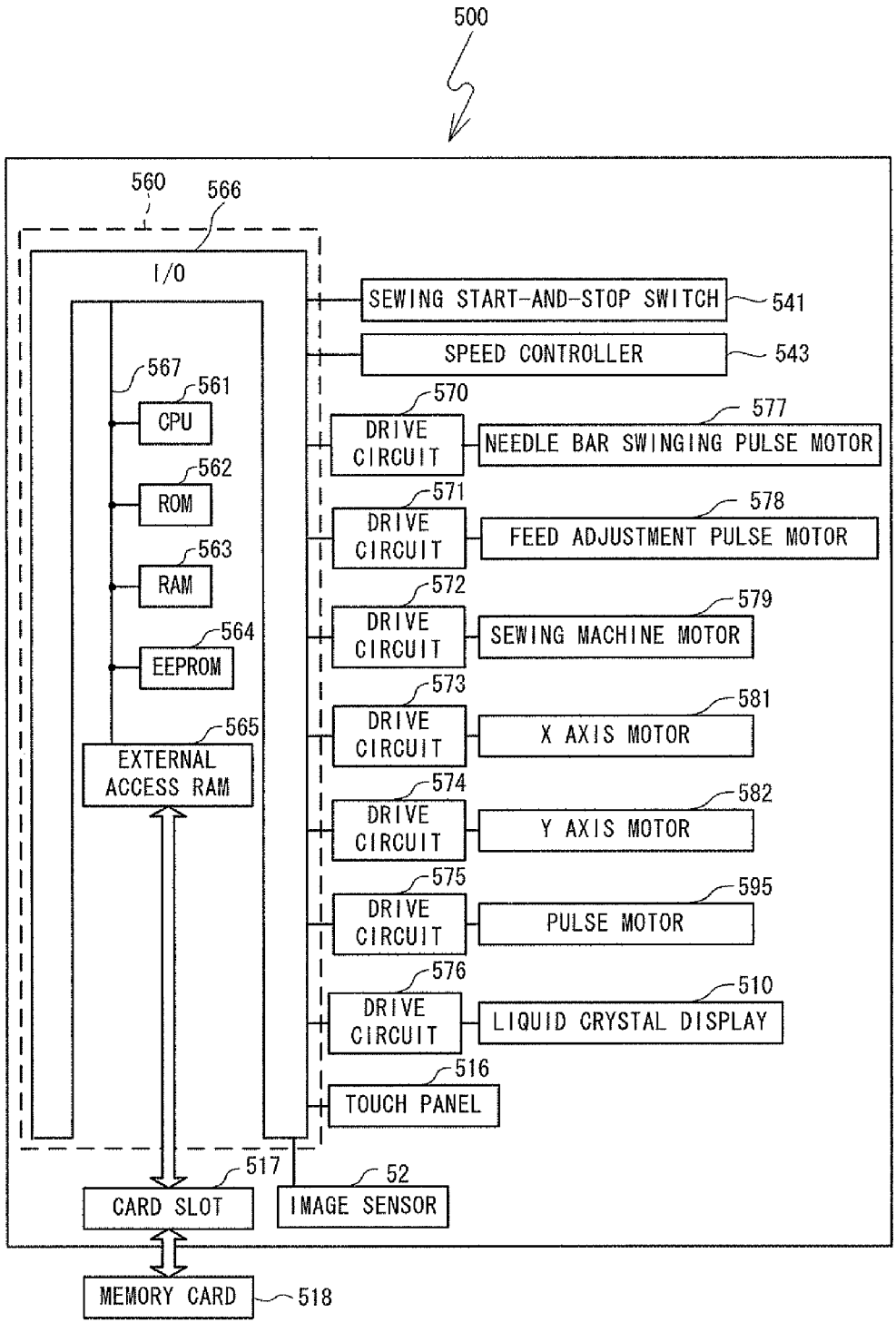
FIG. 33 is a block diagram that shows an electrical configuration of the sewing machine.

A main electrical configuration of the sewing machine 500 will be explained with reference to FIG. 33. As shown in FIG. 33, a control portion 560 of the sewing machine 500 includes a CPU 561, a ROM 562, a RAM 563, an EEPROM 564, an external access RAM 565, and an input and an output interface (I/O) 566, which are connected to one another via a bus 567.

The CPU 561 conducts main control over the sewing machine 500 and executes various types of computation and processing in accordance with a program stored in a storing device such as the ROM 562. The ROM 562 may include a plurality of storage areas that include the program storage area. A plurality of programs, including a sewing program and an image capture program, may be stored in the program storage area. The programs may also be stored in an external storage device such as a flexible disk or the like. The RAM 143 is a storage element that can be read from and written to as desired. The EEPROM 144 is a storage element that can be read from and written to as desired, and various types of parameters to perform various types of processing may be stored in the EEPROM 144. A card slot 517 is connected to the external access RAM 565. The card slot 517 can be connected to a memory card 518. If the card slot 517 and the memory card 518 are connected, it is possible for information to be read from and written to the memory card 518.

The sewing start-and-stop switch 541, the speed controller 543, drive circuits 570 to 576, a touch panel 516, and the image sensor 52 are connected to the I/O 566. The drive circuit 570 drives the needle bar swinging pulse motor 577 in accordance with a control signal from the control portion 560. The needle bar swinging pulse motor 577 is the drive source for the needle bar swinging mechanism (not shown in the drawings). The drive circuit 571 drives the feed adjustment pulse motor 578 in accordance with a control signal from the control portion 560. The drive circuit 572 drives the sewing machine motor 579. The sewing machine motor 579 is the drive source for the main shaft (not shown in the drawings). The drive circuit 573 drives the X axis motor 581 in accordance with a control signal from the control portion 560. The drive circuit 574 drives the Y axis motor 582 in accordance with a control signal from the control portion 560. The drive circuit 575 drives the pulse motor 595 in accordance with a control signal from the control portion 560. The drive circuit 576 drives the LCD 510 in accordance with a control signal from the control portion 560. Other structural elements that are not shown in the drawings may be connected to the I/O 566 as desired.

Image capture processing in the sewing machine 500 according to the fourth embodiment will be explained. The image capture processing according to the fourth embodiment is performed by the same sort of procedure as the image capture processing according to the third embodiment in FIG. 26. In the sewing machine 500 according to the fourth embodiment, the image capture processing that is shown in FIG. 26 is performed by the CPU 561 that is shown in FIG. 33, in accordance with image capture program that is stored in the ROM 562.

First, an overview of the image capture processing according to the fourth embodiment will be explained. In the following explanation of the image capture processing according to the fourth embodiment, it is assumed that the image sensor 52 is at the first corresponding position when the image capture processing starts. In the same manner as the sewing machine 1 according to the third embodiment, the sewing machine 500 according to the fourth embodiment is adapted to set one of the first condition to the third condition as the image capture condition that combines the image capture direction and the image capture position, in the same manner as in the third embodiment. In the fourth embodiment, the normal position of the image sensor 52 is the position that is shown in FIG. 34. The sewing machine 500 according to the fourth embodiment sets the position of the sensor unit 680 in the vertical direction in accordance with the image capture condition. The correspondences between each of the image capture conditions and the position of the sensor unit 680 in the vertical direction will be described later. The image capture condition is selected by the user and is input by the panel operation as a part of the move command.

The image capture processing according to the fourth embodiment will be explained with reference to FIG. 26 in more detail. As shown in FIG. 26, in the image capture processing according to the fourth embodiment, the CPU 561 waits for the move command to be acquired (NO at Step S10). In a case where the move command that has been acquired at Step S10 (YES at Step S10) is not a position change command and is not a direction change command (NO at Step S20; NO at Step S22), the image capture condition is set to the first condition (Step S46). At Step S46, the sensor unit 680 is already in the first corresponding position, so the sensor unit 680 is not moved. In a case where the image capture condition has been set to the first condition, the various members of the drive mechanism 551 are in the positions that are hereinafter described. As shown in FIGS. 34 and 36, the pin 243 of the actuating link member 240 is above the shaft pass-through portion 614. An image capture direction 701 of the image sensor 52 is the facing downward direction, and the position in the vertical direction is the normal position.

Figure 37:
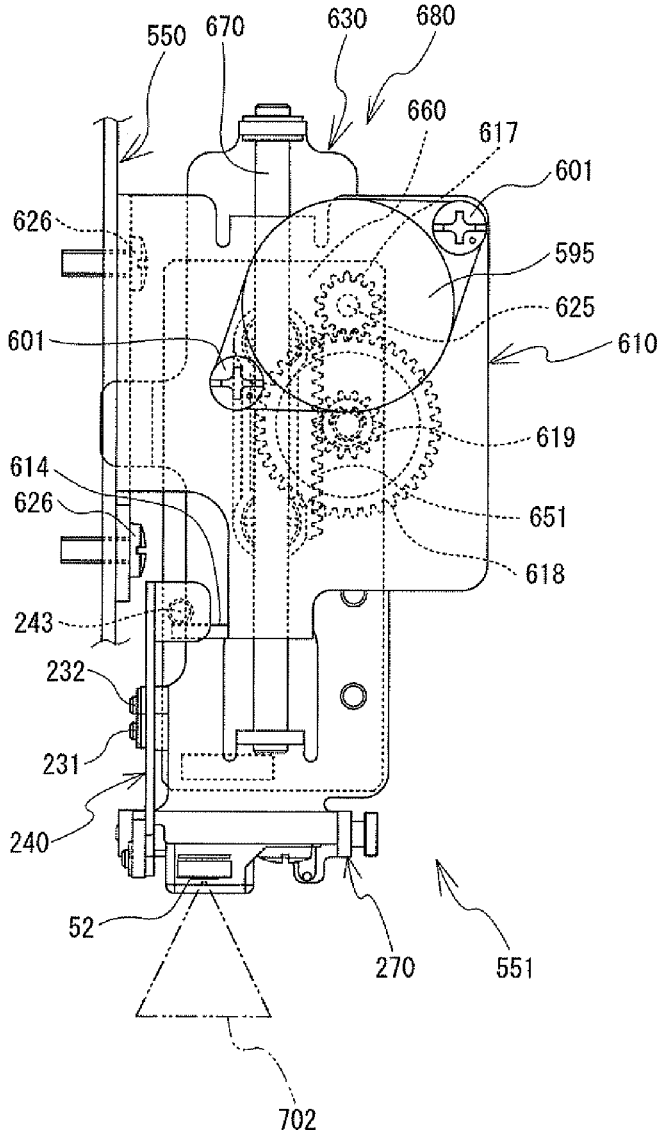
FIG. 37 is a front view of the image sensor drive mechanism when the image sensor is disposed in a zoom position.
Figure 38:
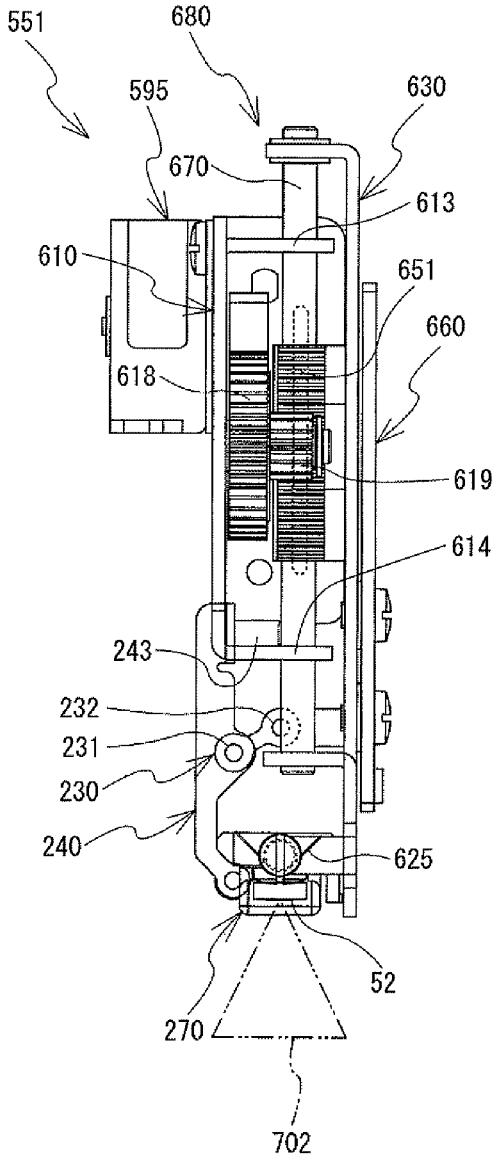
FIG. 38 is a right side view of the image sensor drive mechanism when the image sensor is disposed in the zoom position.

In a case where the move command that has been acquired at Step S10 is a position change command (YES at Step S20), the sensor unit 680 is moved in the vertical direction (Step S34). More specifically, a control signal is output to the drive circuit 575 (refer to FIG. 33), and the pulse motor 595 is driven such that the position of the sensor unit 680 moves to the position in FIG. 37 (a contact position). At Step S34, when the pulse motor 595 operates, the gear 617 is rotated clockwise as seen from the front, and the rack member 650, which meshes with the gear 619, moves downward. When the rack member 650 moves, the base plate 630, to which the rack member 650 is secured, also moves downward, being guided by the shaft 670. In a case where the sensor unit 680 (the base plate 630) is at the position in FIG. 37, the members of the drive mechanism 551 are in the positions that are hereinafter described. As shown in FIGS. 37 and 38, the pin 243 of the actuating link member 240 is in contact with the shaft pass-through portion 614. The positional relationship between the actuating link member 240 and the base plate 630 is the same as the positions at Step S46. The position of the image sensor 52 in the vertical direction is the zoom position. The zoom position is vertically lower than the position in FIG. 34. An image capture direction 702 of the image sensor 52 is the facing downward direction.

Figure 39:
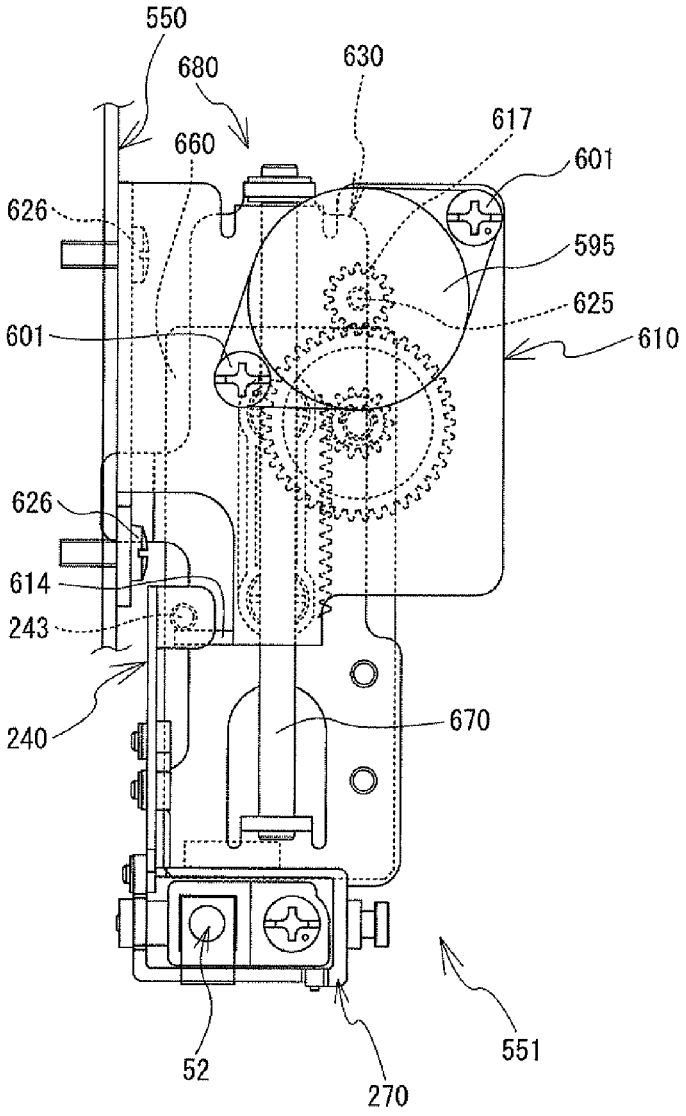
FIG. 39 is a front view of the image sensor drive mechanism when the image capture direction has been set to facing forward.
Figure 40:
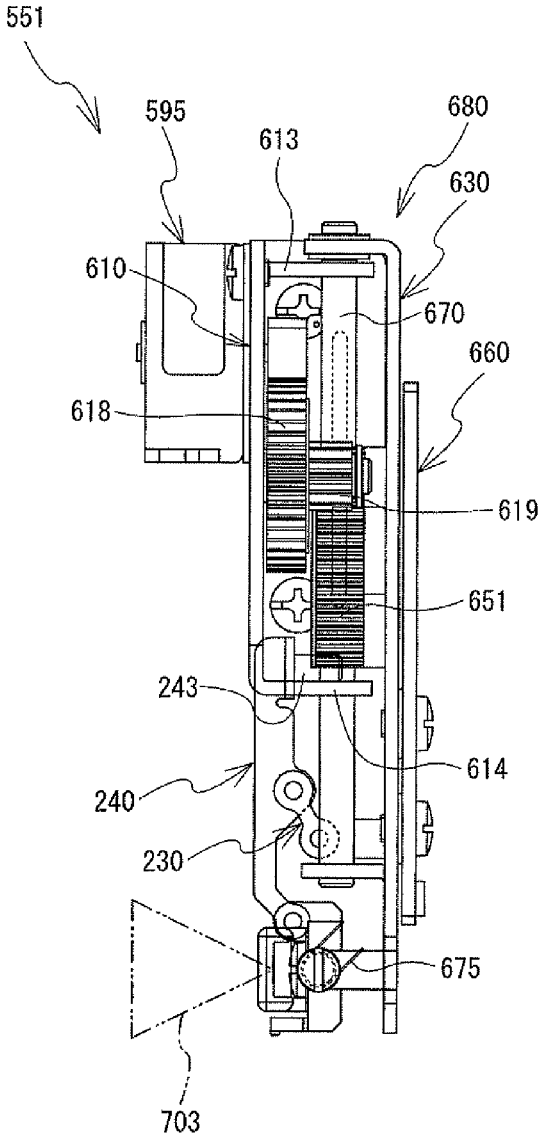
FIG. 40 is a right side view of the image sensor drive mechanism when the image capture direction has been set to facing forward.

In a case where the move command that has been acquired at Step S10 is a direction change command (NO at Step S20; YES at Step S22), the sensor unit 680 is moved vertically lower than the position in FIG. 37 (Step S44). More specifically, a control signal is output to the drive circuit 575, and the pulse motor 595 is driven such that the position of the sensor unit 680 moves to the position in FIG. 39. In the same manner as at Step S34, when the pulse motor 595 operates, the base plate 630, to which the rack member 650 is secured, moves downward, being guided by the shaft 670. In a case where the sensor unit 680 (the base plate 630) is at the position in FIG. 39, the members of the drive mechanism 551 are in the positions that are hereinafter described. As shown in FIGS. 39 and 40, the pin 243 of the actuating link member 240 is in contact with the shaft pass-through portion 614. At the position in FIG. 39, an image capture direction 703 of the image sensor 52 is the facing forward direction. The positional relationship between the actuating link member 240 and the base plate 630 is different from the positions in FIG. 37.

The operation of the drive mechanism 551 at Step S44 will be explained. When the sensor unit 680 is moved lower than the position in FIG. 37 (the contact position), the downward movement of the pin 243 of the actuating link member 240 is restricted by the shaft pass-through portion 614, and the absolute position of the pin 243 is kept fixed. In the state in which the absolute position of the pin 243 is kept fixed, when the sensor unit 680 is moved downward, the pin 231 of the driven link member 230 is moved upward in relation to the sensor unit 680. Therefore, in the case where the sensor unit 680 (the base plate 630) is moved from the position in FIG. 37 (the contact position) to the position in FIG. 39 (a direction change position), the image sensor 52 (the sensor link member 270) is rotated ninety degrees clockwise as seen from the right side, in the same manner as in the second embodiment. In a case where the sensor unit 680 (the base plate 630) is moved from the position in FIG. 39 to the position in FIG. 37, the image sensor 52 (the sensor link member 270) is rotated ninety degrees counterclockwise as seen from the right side. The angle of rotation of the image sensor 52 (the sensor link member 270) is determined in accordance with the link ratio of the four-bar parallel linkage and the amount of movement of the pin 243 in relation to the sensor unit 680. The operation of the drive mechanism 551 in the case where the sensor unit 680 is moved from the position in FIG. 39 to the position in FIG. 37 is the opposite of the operation in the case where the sensor unit 680 is moved from the position in FIG. 37 to the position in FIG. 39.

Following whichever of Step S34, Step S44, and Step S46 is performed, an image is captured by the image sensor 52 at a specified timing (Step S50), and the captured image is displayed on the LCD 510 (Step S60).

Using the pulse motor 595 as the drive source, the sewing machine 500 can change one of the image capture direction and the position in the vertical direction of the image sensor 52 in relation to the arm 504. More specifically, using the pulse motor 595 as the drive source, the sewing machine 500 moves the sensor unit 680 in the up-down direction. By moving the sensor unit 680 in the up-down direction, the sewing machine 500 can perform one of the changing of the position in the vertical direction and the changing of the image capture direction of the image sensor 52. Therefore, by inputting commands, the user can acquire images with different fields of view before and after the moving, particularly images for which one of the image capture directions and the scale ratio are different. The sewing machine 500 utilizes the pulse motor 595 as the drive source for changing the position of the image sensor 52 in the vertical direction and as the drive source for changing the image capture direction of the image sensor 52. Therefore, the sewing machine 500 can provide a configuration for the sewing machine 500 that is simpler than the configuration in a case where two drive sources are provided separately.

The sewing system of the present disclosure is not limited to the embodiment that is described above, and various types of modifications may be made within the scope of the present disclosure. For example, the modifications that are described below from (A) to (F) may be made as desired.

(A) The type of the image sensor 52 may be changed as desired. The image sensor 151 may also be an image capture element other than a CMOS image sensor, such as a CCD camera or the like, for example.

(B) The position in which the image sensor 52 is disposed may be changed as desired. For example, the image sensor 52 may be disposed as in any one of (B-1) to (B-4) below.

(B-1) For example, the image sensor 52 may be disposed on the left side of the needle bar case 21 instead of on the right side. As another example, the image sensor 52 may be disposed in a position that is located between a plurality of the needle bars 31. More specifically, for example, the image sensor 52 may be disposed within the frame 24 of the needle bar case 21 that is shown in FIG. 2, between a needle bar number three that is the third from the right and a needle bar number four that is the fourth from the right. In this case, the distance between the image sensor 52 and the needle bar 31 that is in the position that is the farthest from the image sensor 52 (the needle bar 31 that is the farthest toward the outer side) can be shortened. In this case, a case where one of the engaging rollers 42 that is disposed from the first to the third and the sixth to the ninth from the left is engaged with the positioning portion 481 of the helical cam 48 is called a case in which the needle bar case 21 is in a sewing position, for example. A case where one of the forth and the fifth of the engaging rollers 42 from the left is engaged with the positioning portion 481 of the helical cam 48 is called a case in which the needle bar case 21 is in an image capture position, for example. Therefore, in this case, it is possible to shorten the distance that the needle bar case 21 is moved when the image sensor 52 is moved from the sewing position to the image capture position.

(B-2) In the embodiments that are described above, the distance between the image sensor 52 and the needle bar 31 that is adjacent to the image sensor 52 is an integer multiple of the interval X between the needle bars 31. However, the distance between the image sensor 52 and the adjacent needle bar 31 may also be a value other than an integer multiple of the interval X. Further, in the first to the third embodiments that are described above, the needle bar case 21 stops at a position that is one of nine positions, depending on which of the engaging rollers 42 is engaged with the positioning portion 481 of the helical cam 48, but the positions at which the needle bar case 21 stops are not limited to these examples. For example, the sewing machine may be adapted to stop the needle bar case 21 at any desired position within the range of movement of the needle bar case 21.

(B-3) In the embodiments that are described above, the central axis lines of the plurality of the needle bars 31 and the image sensor 52 are disposed along a single straight line in a plan view. This makes it possible for the sewing machine 1 to move the image sensor 52 easily to the position that is directly above the needle drop point. However, in a multi-needle sewing machine in which a travel path of a needle bar case is arc-shaped in a plan view, for example, needle bars and an image sensor may also be disposed in an arc shape, such that the image sensor also travels along an arc-shaped travel path, together with the needle bars.

(B-4) In the embodiments that are described above, the image capture direction of the image sensor 52 is set to one of facing downward and facing forward, but the image capture direction can be changed as desired.

(C) In the sewing machine 1 in the embodiments that are described above, the image capture processing that is performed can be changed as desired. For example, in the embodiments that are described above, the position of the image sensor 52 when the image capture processing starts is assumed to be the sewing position, in order to simplify the explanation, but any desired position may be set as the position of the image sensor 52 when the image capture processing starts. Furthermore, the sewing machine 1 may also switch the image capture conditions for the image sensor 52 at any time, in accordance with a command that the user inputs to the sewing machine 1, for example. Specifically, in the image capture processing according to the first embodiment that is shown in FIG. 9, for example, the sewing machine 1 may also switch the image capture position of the image sensor 52 from the normal position to the zoom position, and from the zoom position to the normal position, in accordance with a command that the user inputs to the sewing machine 1. To take another example, the method for acquiring the command at Step S10 can be changed as desired. More specifically, the command may also be input by a dedicated button with which the sewing machine is provided. As yet another example, in the embodiments that are described above, at Step S60 in the image capture processing that is shown in FIG. 9, the image that is captured by the image sensor 52 is displayed on the LCD 7. However, the image that is captured by the image sensor 52 at Step S50 may also be used for other processing.

(D) The sewing machine 1 according to the embodiments that are described above is provided with one of the guide hole 84, the guide hole 284, the guide hole 384, and the guide hole 386 as a guide portion, but the guide portion is not limited to these examples. For example, the guide portion may also be a rail with which one of the pin 78 and the pin 243 engages. The length, the shape, and the angle of inclination of the guide portion in relation to the direction of movement of the needle bar case 21 can each be changed as desired.

(E) The configuration of the coupling members with which the sewing machine 1 is provided according to the embodiments that are described above, and the shapes of the individual members that configure the coupling members, can be changed as desired. For example, in the second to the fourth embodiments, the image sensor 52 may also be rotated at least ninety degrees by changing structural conditions and operating conditions of the four-bar parallel linkage. An example of a structural condition would be the link ratio. An example of an operating condition would be the amount of movement of the pin 243 of the actuating link member 240 in the four-bar parallel linkage.

(F) The configurations of the sewing machine 1 and the sewing machine 500 can be changed as desired. In a case where the present disclosure is applied to a multi-needle sewing machine like the sewing machine 1, the number of the needle bars is not limited to being six and needs only to be a plurality. To take another example, the needle bar case moving mechanism 40 may also be driven manually by the user. As yet another example, the position (the third position) where the body 20 and the needle bar case 21 are in contact can be changed as desired according to the configuration of the sewing machine 1. In still another example, the drive mechanism 551 according to the fourth embodiment may also be applied to the sewing machine 1. Yet another example would be that one of the image capture direction and the position in the vertical direction of the image sensor 52 can also be changed in the fourth embodiment. An additional example would be that while the sewing machine 500 according to the fourth embodiment is provided with the pulse motor 595 as an actuator that serves as the drive source for the sensor unit 680, the sewing machine 500 may also be provided with another actuator.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a body;

a housing the housing portion being a needle bar case that is configured to house a plurality of needle bars;

a bed;

a needle plate that is provided on the bed and includes a needle hole;

an image capture device that is adapted to capture an image of the needle hole;

a moving device that moves the image capture device in relation to the housing portion, the moving device including:

a needle bar case moving mechanism that moves the needle bar case in a horizontal direction in relation to the body; and a coupling member that couples the image capture device to the needle bar case and moves the image capture device in relation to the needle bar case in conjunction with a movement of the needle bar case;

a command acquisition device that acquires a command to move the image capture device in relation to the housing portion; and a moving control device that controls the moving device in accordance with the command that has been acquired by the command acquisition device to move the image capture device in relation to the housing portion, the moving control device controlling the needle bar case moving mechanism in accordance with the command that has been acquired by the command acquisition device to move the needle bar case, thereby causing the coupling member to move the image capture device in relation to the needle bar case.

2. The sewing machine according to claim 1, wherein:

the moving control device, in a case where the command acquisition device has acquired, as the command, a direction change command to change an image capture direction of the image capture device, controls the moving device to move the image capture device to change the image capture direction.

3. The sewing machine according to claim 1, wherein the moving control device, in a case where the command acquisition device has acquired, as the command, a position change command to change a position of the image capture device in a vertical direction in relation to the housing portion, controls the moving device to move the image capture device to change the position of the image capture device in the vertical direction in relation to the housing portion.

4. The sewing machine according to claim 1, wherein:

the coupling member includes:

a supporting member that is slidably supported by the needle bar case and that supports the image capture device such that an image capture direction of the image capture device can be changed; and a guide member that is secured to the needle bar case and that includes a guide portion, the guide portion operating in coordination with the supporting member to determine the image capture direction of the image capture device, the moving control device controls the needle bar case moving mechanism to move the needle bar case, in accordance with the command that has been acquired by the command acquisition device, to a position between a first position and a second position, the first position and the second position being positions between which a third position is located;

the supporting member, in a case where the needle bar case is moved between the first position and the third position, moves with the needle bar case, with the image capture direction being maintained in a specified direction; and the supporting member, in a case where the needle bar case is moved between the second position and the third position, makes contact with the body, slides in relation to the needle bar case, and operates in coordination with the guide portion to change the image capture direction.

5. The sewing machine according to claim 1, wherein:

the coupling member includes:

a supporting member that is slidably supported by the needle bar case and that supports the image capture device such that a position of the image capture device in a vertical direction can be changed; and a guide member that is secured to the needle bar case and that includes a guide portion, the guide portion operating in coordination with the supporting member to determine the position of the image capture device in the vertical direction;

the moving control device controls the needle bar case moving mechanism, to move the needle bar case, in accordance with the command that has been acquired by the command acquisition device, to a position between a first position and a second position, the first position and the second position being positions between which a third position is located;

the supporting member, in a case where the needle bar case is moved between the first position and the third position, moves the needle bar case, with the position of the image capture device in the vertical direction being maintained at a specified position; and the supporting member, in a case where the needle bar case is moved between the second position and the third position, makes contact with the body, slides in relation to the needle bar case, and operates in coordination with the guide portion to change the position of the image capture device in the vertical direction.

6. A sewing machine, comprising:

a body;

a housing portion, the housing portion being a needle bar case that is configured to house a plurality of needle bars;

a bed;

a needle plate that is provided on the bed and includes a needle hole;

an image capture device that is adapted to face downward and that is adapted to capture an image from above the needle hole;

a moving device that moves the image capture device in relation to the housing portion, the moving device including:

a needle bar case moving mechanism that moves the needle bar case in a horizontal direction in relation to the body; and a coupling member that couples the image capture device to the needle bar case and moves the image capture device in relation to the needle bar case in conjunction with a movement of the needle bar case;

a command acquisition device that acquires a command to move the image capture device in relation to the housing portion; and a moving control device that controls the moving device in accordance with the command that has been acquired by the command acquisition device to move the image capture device in relation to the housing portion, the moving control device controls the needle bar case moving mechanism in accordance with the command that has been acquired by the command acquisition device to move the needle bar case, thereby causing the coupling member to move the image capture device in relation to the needle bar case.

7. A non-transitory computer-readable medium storing a control program executable on a sewing machine that includes a body, a housing portion, a bed, a needle plate that is provided in the bed and has a needle hole, and an image capture device that is at least either capable of capturing an image of the needle hole or capable of capturing an image facing downward from above the needle hole, the program comprising instructions that cause a controller of the sewing machine to perform the steps of:

acquiring a command to move the image capture device in relation to the housing portion; and controlling, in accordance with the command, a moving device that moves the image capture device in relation to the housing portion to move the image capture device in relation to the housing portion, wherein:

the housing portion is a needle bar case that is configured to house a plurality of needle bars;

the moving device includes:

a needle bar case moving mechanism that moves the needle bar case in a horizontal direction in relation to the body; and a coupling member that couples the image capture device to the needle bar case and moves the image capture device in relation to the needle bar case in conjunction with a movement of the needle bar case, and the moving control device controls the needle bar case moving mechanism in accordance with the command that has been acquired by the command acquisition device to move the needle bar case, thereby causing the coupling member to move the image capture device in relation to the needle bar case.

* * * * *